US008681060B2

(12) United States Patent
Kotaka

(10) Patent No.: US 8,681,060 B2
(45) Date of Patent: Mar. 25, 2014

(54) MULTIBAND ANTENNA AND ELECTRONIC DEVICE

(75) Inventor: Yuki Kotaka, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 302 days.

(21) Appl. No.: 13/197,089

(22) Filed: Aug. 3, 2011

(65) Prior Publication Data

US 2012/0038535 A1 Feb. 16, 2012

(30) Foreign Application Priority Data

Aug. 12, 2010 (JP) ..... 2010-180718

(51) Int. Cl.
*H01Q 1/24* (2006.01)

(52) U.S. Cl.
USPC ..... 343/702; 343/700 MS; 343/846

(58) Field of Classification Search
USPC ..... 343/700, 702, 829, 846, 848
See application file for complete search history.

(56) References Cited

U.S. PATENT DOCUMENTS

| | | | | |
|---|---|---|---|---|
| 4,864,320 | A * | 9/1989 | Munson et al. | 343/833 |
| 5,420,599 | A * | 5/1995 | Erkocevic | 343/828 |
| 7,161,543 | B2 * | 1/2007 | Cheng et al. | 343/702 |
| 7,916,089 | B2 * | 3/2011 | Schlub et al. | 343/702 |
| 8,063,834 | B2 * | 11/2011 | Boyle | 343/702 |
| 2004/0125031 | A1 | 7/2004 | Jo et al. | |
| 2007/0146213 | A1 | 6/2007 | Soekawa et al. | |
| 2007/0241972 | A1 | 10/2007 | Grossman et al. | |

FOREIGN PATENT DOCUMENTS

| | | |
|---|---|---|
| GB | 2 437 115 | 10/2007 |
| JP | 2001-223519 A | 8/2001 |
| JP | 2009-111959 A | 5/2009 |
| JP | 2009-124355 A | 6/2009 |

OTHER PUBLICATIONS

Extended European Search Report (EESR) dated Dec. 13, 2011 (in English) in counterpart European Application No. 11176878.4.
Japanese Office Action dated Nov. 27, 2012 (and English translation thereof) in counterpart Japanese Application No. 2010-180718.
Korean Office Action dated Oct. 18, 2012 (and English translation thereof) in counterpart Korean Application No. 10-2011-0074083.

* cited by examiner

*Primary Examiner* — Tho G Phan
(74) *Attorney, Agent, or Firm* — Holtz, Holtz, Goodman & Chick, PC

(57) ABSTRACT

Disclosed is a multiband antenna, comprising: an antenna element section which is fed from a feeding point; and a ground element section which is connected to a ground of the feeding point; wherein the antenna element section includes: a pole element which includes the feeding point, and has a length at which the pole element resonates at a first frequency; an L-shaped folded-back element which is connected to an end of the pole element, and resonates at a second frequency together with the pole element; and an L-shaped added element which is connected to the pole element; wherein a length from the feeding point to an end of the added element is a length at which the added element resonates at the first frequency.

8 Claims, 20 Drawing Sheets

MULTIBAND ANTENNA AND ELECTRONIC DEVICE

CROSS-REFERENCE TO RELATED APPLICATIONS

This application is based upon and claims the benefit of priority from the prior Japanese Patent Application No. 2010-180718, filed on Aug. 12, 2010, the entire contents of which are incorporated herein by reference.

BACKGROUND OF THE INVENTION

1. Field of the Invention

The present invention relates to a multiband antenna and an electronic device.

2. Description of Related Art

Mobile devices having wireless communication functions, such as a handy terminal and a personal digital assistant (PDA), have conventionally been known. A multiband antenna having a plurality of resonance frequencies has been known as one of wireless communication antennas to be mounted on such mobile devices.

Moreover, a parallel two-line antenna having two resonance frequencies has been known as one of the multiband antennas (see, for example, Japanese Patent Application Laid-Open Publication No. 2009-124355). The parallel two-line antenna can have two resonance frequencies by closely arranging two radiative conductors having the same lengths in a folded-back shape.

Moreover, a configuration using a monopole antenna, the structure of which is simpler than that of the parallel two-line antenna, as one of the multiband antennas has been known. The monopole antenna has the configuration of using one side of two antenna elements of a half-wave dipole antenna as the ground thereof.

FIG. 26 shows the configuration of a conventional monopole antenna 80. As shown in FIG. 26, the monopole antenna 80 includes an antenna element 81 and a ground section 82. A feeding point P is arranged between the antenna element 81 and the ground section 82. The antenna element 81 has a length of (¼)λ0 (λ0: the wavelength of a predetermined frequency), and resonates at a frequency f0 corresponding to the wavelength λ0 and a frequency 3f0 that is three times as large as the frequency f0. The monopole antenna consequently functions as a multiband antenna resonating at the two frequencies f0 and 3f0.

Moreover, a monopole antenna having a folding-back structure of folding back the tip of an antenna element has been known (see, for example, Japanese Patent Application Laid-Open Publication No. 2001-223519). The monopole antenna of the folding-back structure resonates at a frequency higher than the frequency f0 and a frequency lower than the frequency 3f0 owing to an interaction of the folded-back part.

Moreover, a wireless LAN system has been known as a wireless communication system of a mobile device. IEEE 802.11b/g for a frequency band of a 2.4 GHz band and IEEE 802.11a for a frequency band of a 5 GHz band exist as the standards of wireless LAN systems.

The conventional monopole antenna of the folding-back structure however was not capable of being applied to a multiband antenna resonating in two frequency bands of wireless LAN communication. To put it concretely, when the length of the antenna element of a monopole antenna having the folding-back structure was adjusted in order that the resonance frequency corresponding to the frequency f0 may be adjusted to 2.45 [GHz], the resonance frequency thereof corresponding to the frequency 3f0 was approximately 7.38 [GHz].

The necessary frequency band of the 2.4 GHz band of the IEEE 802.11b/g is a band of from 2.4 to 2.5 [GHz]. Moreover, the necessary frequency band of the 5 GHz band of the IEEE 802.11a is a band of from 5.18 to 5.7 [GHz]. Consequently, even if the shifts of frequencies when a monopole antenna of the folding-back structure was incorporated in a housing were considered, no resonance frequencies satisfying the two necessary frequency bands of wireless LAN communication were capable of being obtained.

SUMMARY OF THE INVENTION

It is an object of the present invention to provide a multiband antenna having the folding-back structure capable of resonating at two arbitrary frequency bands.

According to a first aspect of the present invention, there is provided a multiband antenna, comprising:

an antenna element section which is fed from a feeding point; and a ground element section which is connected to a ground of the feeding point; wherein the antenna element section includes:

a pole element which includes the feeding point, and has a length at which the pole element resonates at a first frequency;

an L-shaped folded-back element which is connected to an end of the pole element, and resonates at a second frequency together with the pole element; and an L-shaped added element which is connected to the pole element; wherein a length from the feeding point to an end of the added element is a length at which the added element resonates at the first frequency.

According to a second aspect of the present invention, there is provided an electronic device comprising:

a multiband antenna, including: an antenna element section which is fed from a feeding point; and a ground element section which is connected to a ground of the feeding point; wherein the antenna element section includes: a pole element which includes the feeding point, and has a length at which the pole element resonates at a first frequency; an L-shaped folded-back element which is connected to an end of the pole element, and resonates at a second frequency together with the pole element; and an L-shaped added element which is connected to the pole element; wherein a length from the feeding point to an end of the added element is a length at which the added element resonates at the first frequency;

a wireless communication section which performs wireless communication with an external device through the multiband antenna; and a control section which controls the wireless communication section.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DESCRIPTION OF THE PREFERRED EMBODIMENT

In the following, a suitable embodiment according to the present invention, a first modification thereof, and a second modification thereof will be described in order with reference to the accompanying drawings. Incidentally, the present invention is not limited to the shown examples.

(Embodiment)

An embodiment according to the present invention will be described with reference to FIGS. 1A-15. First, the apparatus configuration of the handy terminal 1 of the present embodiment will be described with reference to FIGS. 1A-3.

Figure 1C:
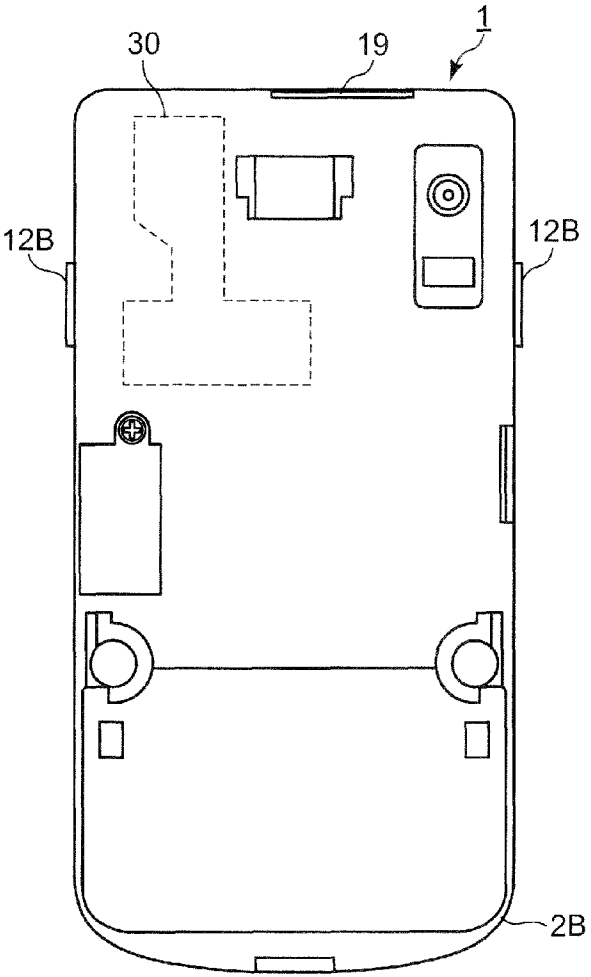
FIG. 1C is a rear view of the handy terminal.
Figure 1B:
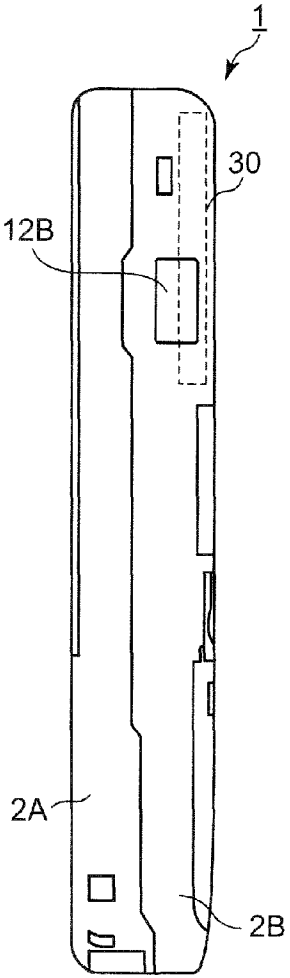
FIG. 1B is a side view of the handy terminal.
Figure 1A:
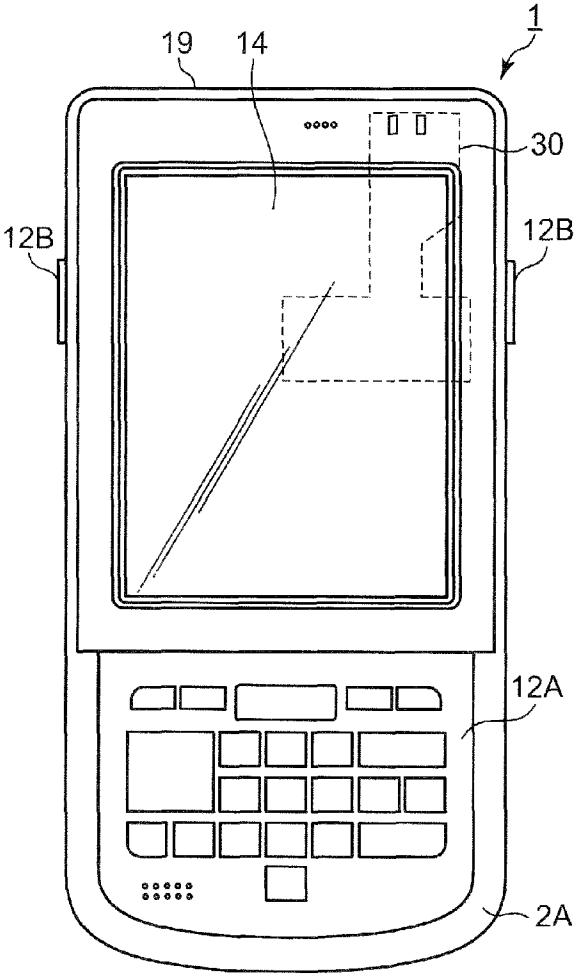
FIG. 1A is a front view of a handy terminal of an embodiment of the present invention.

FIG. 1A is a front view showing the front configuration of the handy terminal 1 of the present embodiment.

FIG. 1B is a side view showing the side configuration of the handy terminal 1.

FIG. 1C is a rear view showing the rear configuration of the handy terminal 1.

Figure 2:
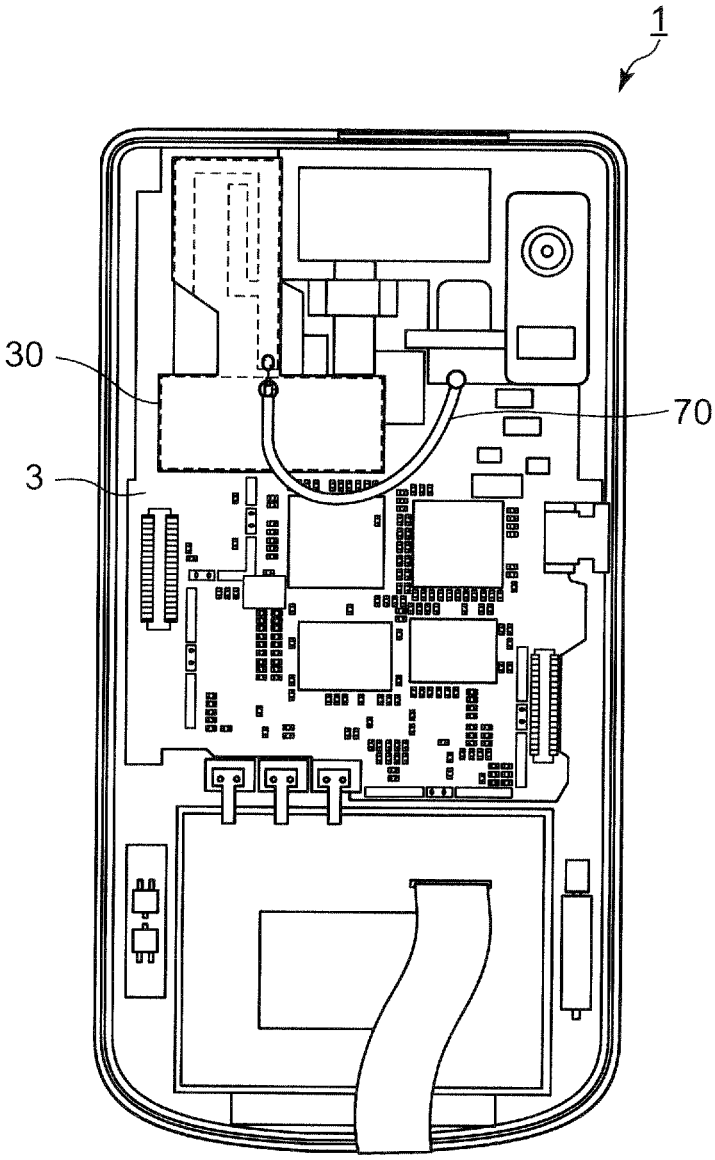
FIG. 2 is a rear view of the handy terminal in the state of taking off the case thereof.

FIG. 2 is a rear view showing the rear configuration of the handy terminal 1 in the state of taking off a case 2B.

Figure 3:
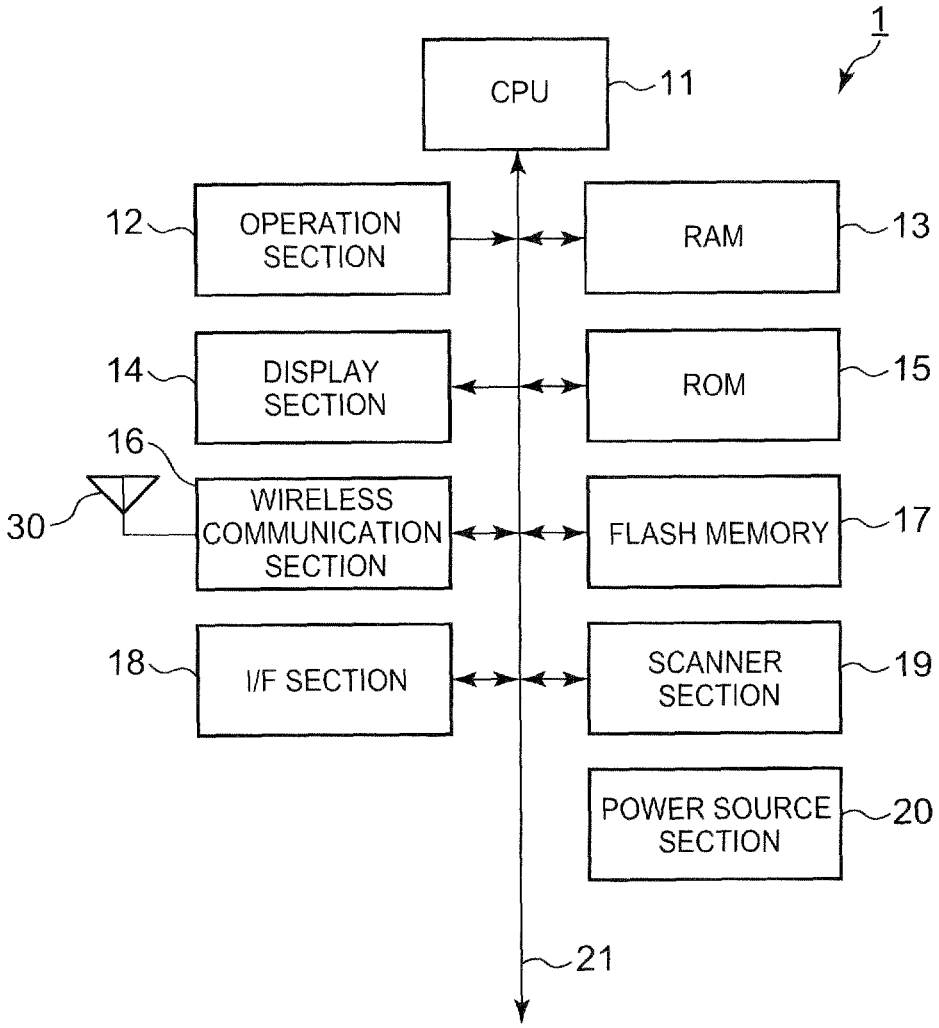
FIG. 3 is a block diagram showing the functional configuration of the handy terminal.

FIG. 3 is a block diagram showing the functional configuration of the handy terminal 1.

The handy terminal 1 as an electronic device of the present embodiment is a mobile device having the functions of inputting information by a user's operation, storing information, scanning a bar code, and the like. Moreover, the handy terminal 1 has the function of communicating with an external device through an access point by a wireless local area network (LAN) system.

As shown in FIG. 1A, the handy terminal 1 is equipped with a display section 14, various keys 12A, and the like on a case 2A on the front side thereof. Moreover, the handy terminal 1 is equipped with a scanner section 19 at an end of the case 2A. Moreover, the handy terminal 1 is, as shown in FIGS. 1B and 1C, equipped with trigger keys 12B on both the sides of the case 2B on the rear side. Moreover, the handy terminal 1 is equipped with a multiband antenna 30 inside of the cases 2A and 2B.

The various keys 12A includes inputting keys of characters, such as numerals; various function keys; a trigger key receiving light irradiation of the scanner section 19 and a trigger operation input of bar code scanning; and the like. The trigger keys 12B are trigger keys of the scanner section 19 similarly to the trigger key in the various keys 12A. The scanner section 19 is a part radiating a light, such as a laser light, onto a bar code, and receiving and binarizing the reflected light to read the data of the bar code.

As shown in FIG. 2, the handy terminal 1 incorporates a circuit substrate 3. The multiband antenna 30 is connected to a module for wireless LAN communication provided on the circuit substrate 3 through a coaxial cable 70. The multiband antenna 30 is a multiband antenna capable of performing communication in both of the frequency bands of the 2.4 GHz band of the IEEE 802.11b/g and the 5 GHz band of the IEEE 802.11a of the standard of the wireless LAN communication.

As shown in FIG. 3, the handy terminal 1 includes a central processing unit (CPU) 11, an operation section 12, a random access memory (RAM) 13, the display section 14, a read only memory (ROM) 15, the multiband antenna 30, a wireless communication section 16, a flash memory 17, an interface (I/F) section 18, the scanner section 19, and a power source section 20. The CPU 11, the operation section 12, the RAM 13, the display section 14, the ROM 15, the wireless communication section 16, the flash memory 17, the I/F section 18, and the scanner section 19 are connected to one another through a bus 21.

The CPU 11 controls each section of the handy terminal 1. The CPU 11 develops a system program and a designated program among various application programs stored in the ROM 15 into the RAM 13, and executes various kinds of processing in corporation with the programs developed in the RAM 13.

The CPU 11 receives an input of operation information through the operation section 12 in corporation with various programs and reads out various kinds of information from the ROM 15 to perform the reading and the writing of the various kinds of information against the flash memory 17. Moreover, the CPU 11 performs communication with an external device through an access point by the wireless LAN system with the wireless communication section 16 and the multiband antenna 30, and reads the data of a bar code with the scanner section 19, and further performs cable communication with an external device through the I/F section 18.

The operation section 12 includes the various keys 12A and the trigger keys 12B and outputs an operation signal of each key that has been depressed for an input by an operator to the CPU 11. Moreover, the operation section 12 may be configured to include a touch pad of a touch panel integrally formed with the display section 14.

The RAM 13 is a volatile memory temporarily storing information and has a work area for storing various programs to be executed, the data pertaining to the various programs, and the like. The display section 14 is composed of a liquid crystal display (LCD), an electro luminescent display (ELD), or the like, and performs various displays in conformity with display signals from the CPU 11.

The ROM 15 is a semiconductor memory storing various programs and various kinds of data in the state of being only for read-out.

The wireless communication section 16 is connected to the multiband antenna 30 and performs transmission and reception of information with an access point through the multiband antenna 30 in conformity with the wireless LAN communication system. The wireless communication section 16 includes a modulation section, a demodulation section, a signal processing section, and the like. The access point works to relay communication between an external device and the handy terminal 1. That is, the handy terminal 1 can perform communication with the external device connected to the access point with the wireless communication section 16 and the multiband antenna 30.

The flash memory 17 is a semiconductor memory capable of reading and writing information, such as various kinds of data.

The I/F section 18 is a cable communication section connected with an external device through a communication cable to perform transmission and reception of information with the external device.

The scanner section 19 includes a light emitting section to emit a laser light or the like, a light receiving section, a gain circuit, a binarization circuit, and the like. In the scanner section 19, a light emitted from the light emitting section is radiated to a bar code; the reflected light of the radiated light is received by the light receiving section to be converted into an electric signal; the converted electric signal is amplified by the gain circuit; and the amplified electric signal is converted into the data of a monochrome bar code image by the binarization circuit. In such a way, the scanner section 19 reads a bar code image and outputs the data of the read bar code image to the CPU 11.

The power source section 20 is composed of a secondary battery and the like to perform power source supply to each section of the handy terminal 1.

Next, the apparatus configuration of the multiband antenna 30 will be described with reference to FIGS. 4-7.

Figure 4:
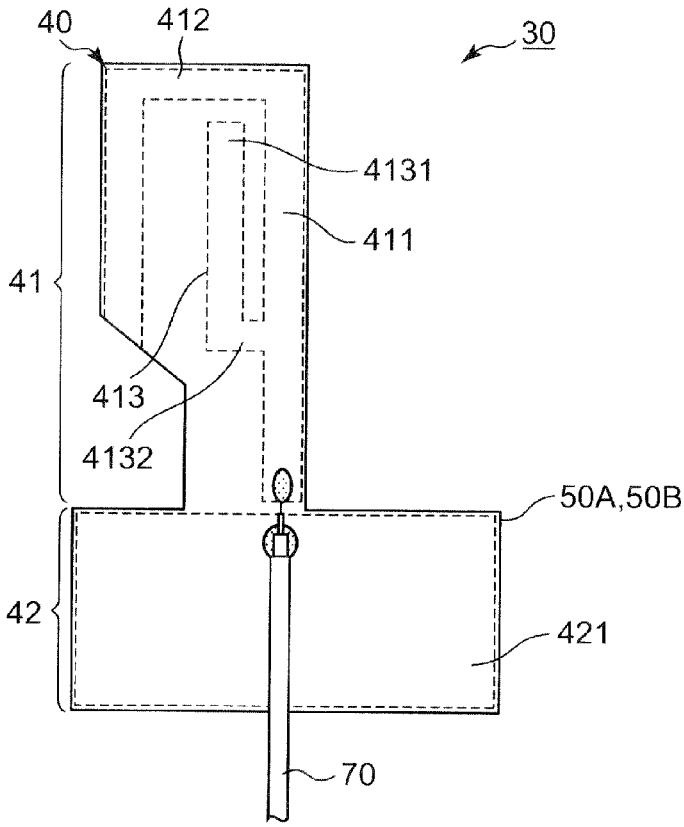
FIG. 4 is a plan view of a multiband antenna of the embodiment.

FIG. 4 is a plan view showing the plane configuration of the multiband antenna 30.

Figure 5:
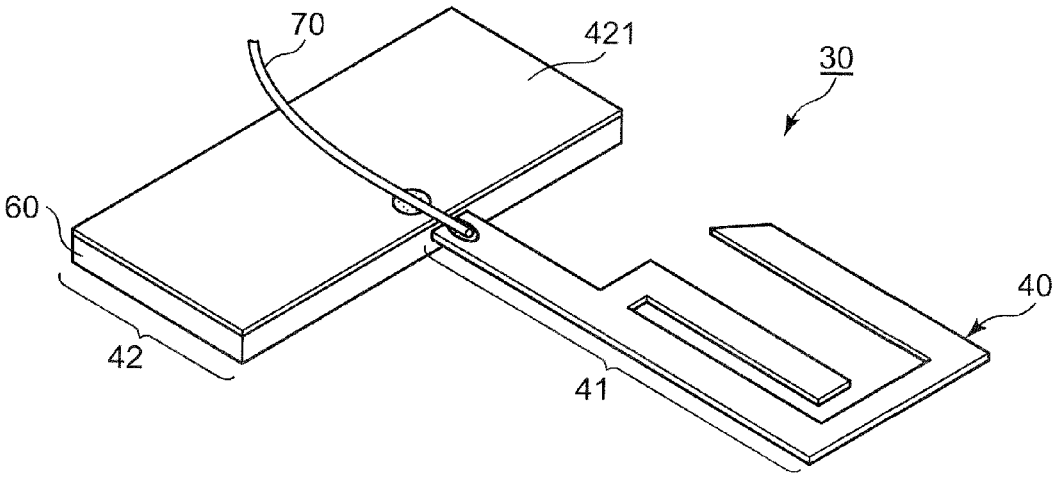
FIG. 5 is a perspective view of the multiband antenna of the embodiment.

FIG. 5 is a perspective view showing the perspective configuration of the multiband antenna 30.

Figure 6:
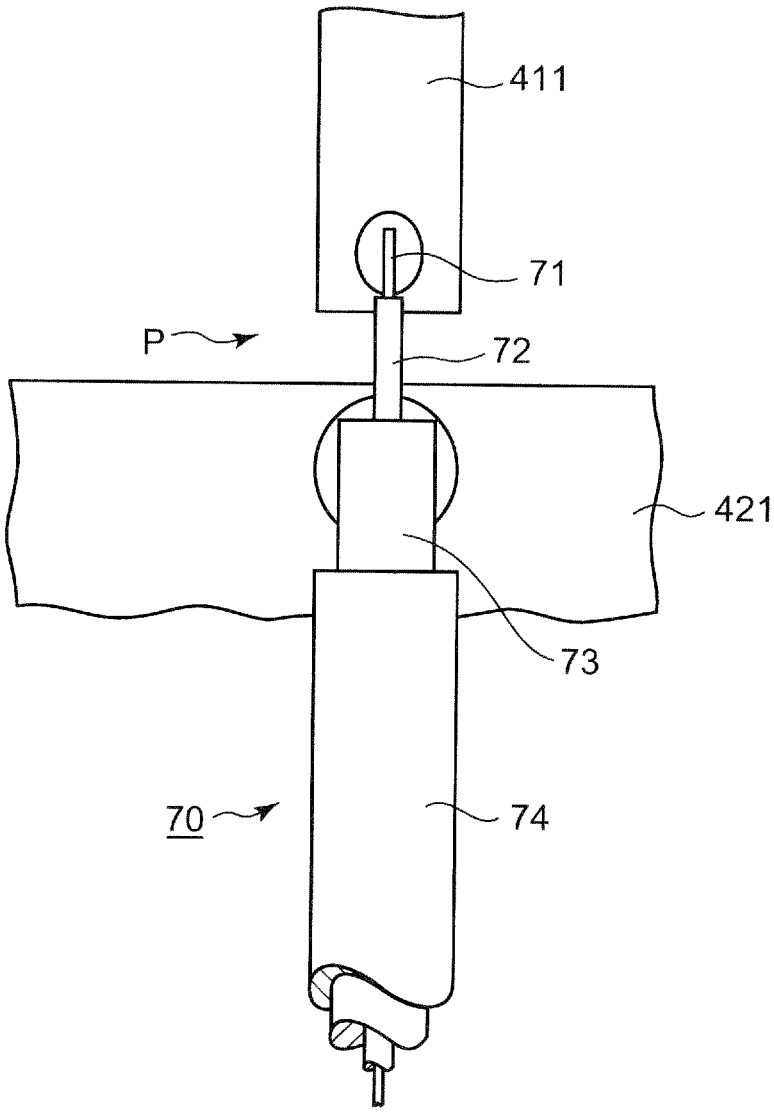
FIG. 6 is a view showing a connectional configuration of the multiband antenna of the embodiment with a coaxial cable.

FIG. 6 is a view showing the connectional configuration of the multiband antenna 30 with the coaxial cable 70.

Figure 7:
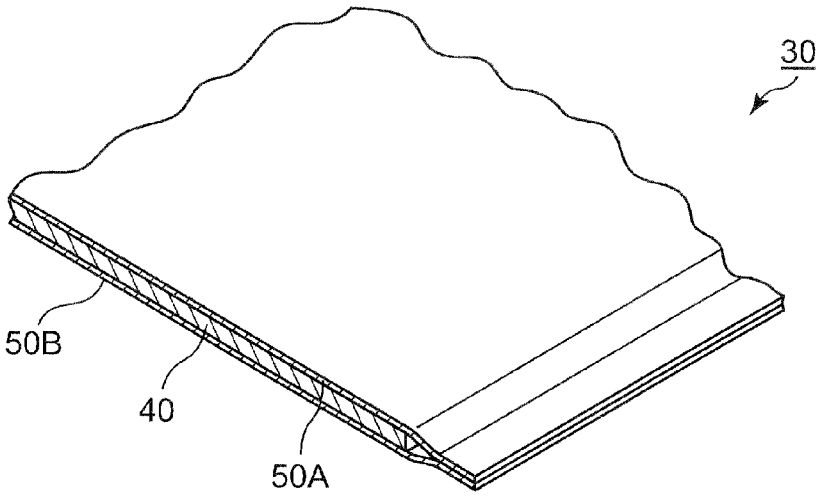
FIG. 7 is a view showing a sectional configuration of the multiband antenna.

FIG. 7 is a view showing the sectional configuration of the multiband antenna 30.

As shown in FIGS. 4 and 5, the multiband antenna 30 includes a conductor section 40, and film sections 50A and 50B. However, the illustration of the film sections 50A and 50B is omitted in FIG. 5. The film section 50A is pasted on the upper side of the planate conductor section 40, and the film section 50B is pasted on the lower side of the conductor section 40. The film sections 50A and 50B are films of flexible print circuits (FPC) and are made of an insulator, such as polyimide.

The conductor section 40 is made of a conductor of a metal, such as copper foil. The conductor section 40 includes an antenna element section 41 and a ground element section 42.

The antenna element section 41 includes a pole element 411, a folded-back element 412, and an added element 413. The pole element 411 is a straight belt-like antenna element and is arranged above the upper side of the ground element section 42 separated from the upper side by a predetermined distance into the vertical direction.

The folded-back element 412 is an L-shaped belt-like antenna element and is connected to an end of the pole element 411. The connection part of the folded-back element 412 is arranged to be perpendicular to the extending direction of the pole element 411. The pole element 411 is folded back by 180 degrees with the folded-back element 412. Moreover, a cut of approximately 45° to the extending direction of the folded-back element 412 is formed at the end thereof.

The added element 413 is an L-shaped belt-like antenna element and is connected to the pole element 411. A part of the added element 413 that is arranged parallelly to the extending direction of the pole element 411 is denoted as an element 4131 as a first element, and a part of the added element 413 that is arranged perpendicularly to the extending direction of the pole element 411 is denoted as an element 4132 as a second element.

The ground element section 42 includes a ground element 421. The ground element 421 is a rectangular element.

As shown in FIG. 5, the multiband antenna 30 is attached to the circuit substrate 3 with a separation section 60. The separation section 60 is made of a spongy insulator or the like. The thickness of the separation section 60 is made to be 5 [mm], for example.

Next, the connection of the multiband antenna 30 and the coaxial cable 70 at the feeding point P will be described with reference to FIG. 6. However, the illustration of the film sections 50A and 50B is omitted in FIG. 6.

The coaxial cable 70 concentrically includes a core wire 71, such as a cupper line, an insulator 72, made of polyethylene or the like, an external conductor 73, such as a mesh-like cupper line, and a protection covering section 74 as an insulator in the order of from the center of a cross section (a surface perpendicular to the extending direction) to the outer side. The core wire 71 of one end of the coaxial cable 70 is connected to the pole element 411 by soldering. The external conductor 73 at the same end is connected to the ground element 421 by soldering. The connection part of the coaxial cable 70 and the conductor section 40 is set as the feeding point P.

Hole portions are formed in advance at the positions corresponding to the soldering parts in the film section 50A. Consequently, the coaxial cable 70 can be soldered to the conductor section 40, on which the film section 50A is pasted, through the hole portions. Moreover, the other end of the coaxial cable 70 is connected to the wireless communication section 16 (the module for wireless LAN communication thereof). High frequency electric power is fed from the wireless communication section 16 (the module for wireless LAN communication thereof) to the feeding point P of the multiband antenna 30 through the coaxial cable 70.

Moreover, as shown in FIG. 7, the sizes of the film sections 50A and 50B are made to be larger than that of the conductor section 40 at the ends of the multiband antenna 30, and the film sections 50A and 50B are pasted together at the ends. Consequently, the conductor section 40 is not exposed, and the influences to the antenna characteristics of the multiband antenna 30 owing to contact of an external member and the conductor section 40 can be reduced.

Next, characteristics of the multiband antenna 30 will be described with reference to FIGS. 8-15. Characteristics of the unit body of the multiband antenna 30 (in the state of not being attached to the housing of the handy terminal 1) will be described with reference to FIGS. 8-11.

Figure 8:
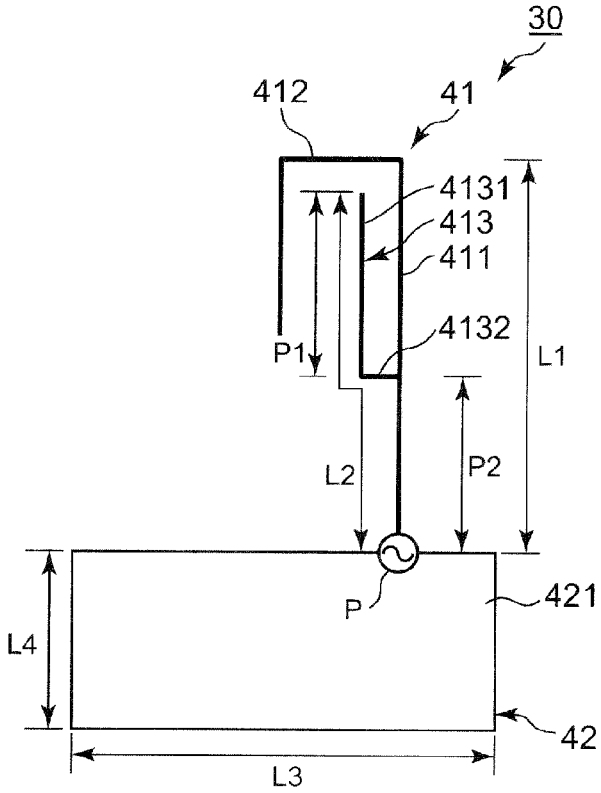
FIG. 8 is a view showing the length of each section of the multiband antenna of the embodiment.

FIG. 8 is a view showing the lengths of the respective sections of the multiband antenna 30.

Figure 9:
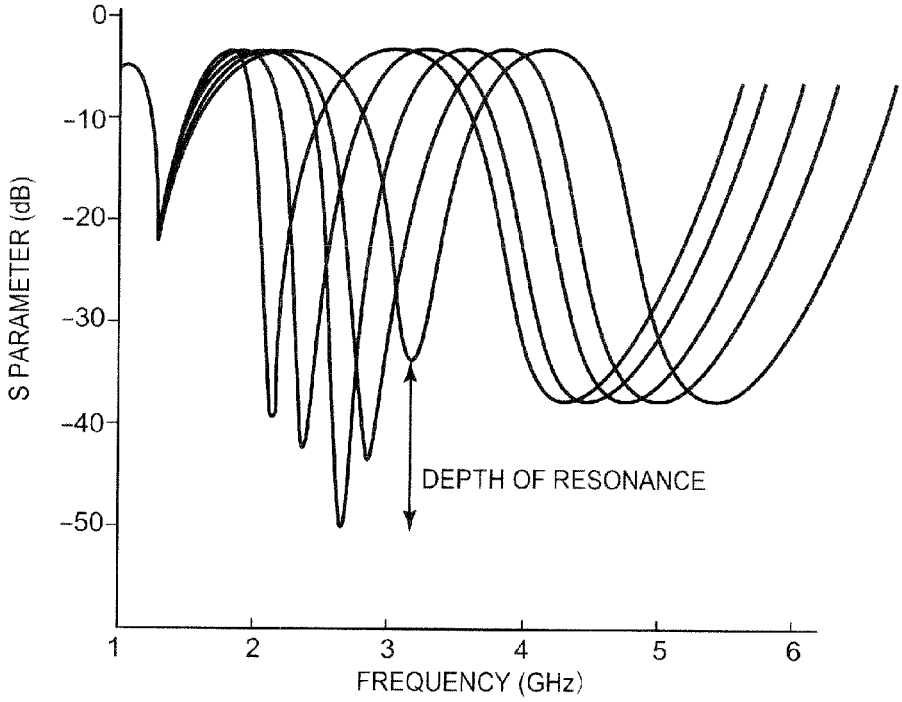
FIG. 9 is a diagram showing S parameters of the unit body of the multiband antenna of the embodiment to frequencies when a first parameter is changed.

FIG. 9 is a diagram showing S parameters of the unit body of the multiband antenna 30 to frequencies at the time of changing a parameter P1.

Figure 10:
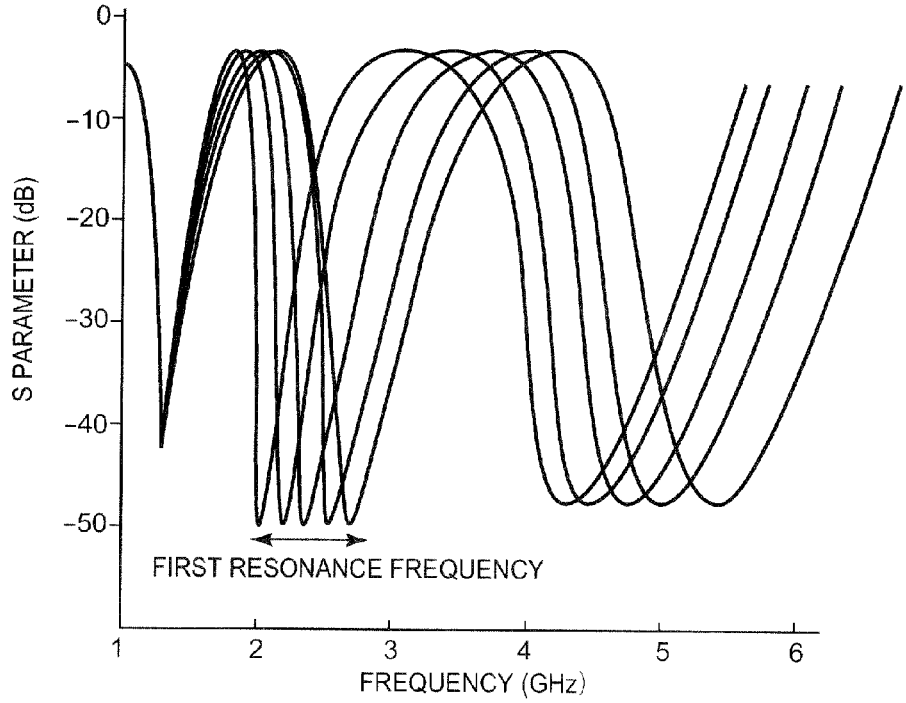
FIG. 10 is a diagram showing S parameters of the unit body of the multiband antenna of the embodiment to frequencies when a second parameter is changed.

FIG. 10 is a diagram showing the S parameters of the unit body of the multiband antenna 30 to frequencies at the time of changing a parameter P2.

Figure 11:
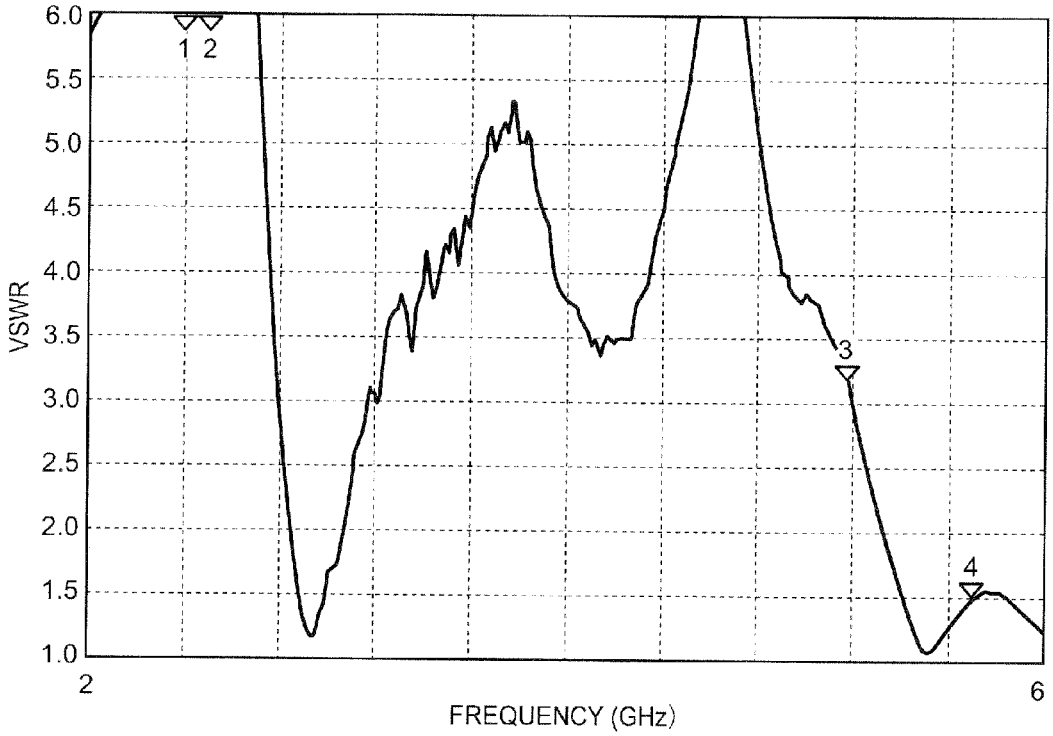
FIG. 11 is a diagram showing voltage standing wave ratios (VSWR) of the unit body of the multiband antenna of the embodiment to frequencies.

FIG. 11 is a diagram showing voltage standing wave ratios (VSWRs) of the unit body of the multiband antenna 30 to frequencies.

First, the lengths of the respective sections of the multiband antenna 30 will be described with reference to FIG. 8. As shown in FIG. 8, the length of the pole element 411 in the extending direction thereof is denoted as a length L1 in the multiband antenna 30. Moreover, the length of the sum of the length of the added element 413 (the sum of the lengths of the elements 4131 and 4132) and the length of the pole element 411 from the connection point with the added element 413 to the feeding point P is denoted as a length L2. Moreover, the length of the ground element 421 in the lengthwise direction thereof is denoted as a length L3. Moreover, the length of the ground element 421 in the crosswise direction thereof is denoted as a length L4.

Furthermore, the length of the element 4131 in the extending direction thereof is denoted as the parameter P1. Moreover, the length of the pole element 411 in the extending direction thereof from the connection point of the pole element 411 and the added element 413 to the feeding point P is denoted as the parameter P2.

Moreover, the length L1 is set to be a length of (¼)λ by using a wavelength λ corresponding to 2.45 [GHz] of the 2.4 GHz band (2.4 [GHz] to 2.5 [GHz]) of wireless LAN communication. A monopole antenna resonates at a frequency corresponding to the wavelength (¼)λ of the element of the pole and a frequency of being three times as large as that frequency. Accordingly, the setting of the length L1 is made in order to make the pole element 411 resonate at 2.45 [GHz] by regarding the pole element 411 as a monopole antenna. This resonance frequency is denoted as a first resonance frequency.

However, because the folded-back element 412 is connected to the pole element 411, the pole element 411 resonates at a frequency smaller than 2.45 [GHz]. In the pole element 411 to which the folded-back element 412 is connected, the length and the shape of the folded-back element 412 are adjusted in order to obtain a threefold resonance frequency in the 5 GHz band (5.18 [GHz] to 5.7 [GHz]) of the wireless LAN communication. The resonance frequency is denoted as a second resonance frequency.

Moreover, the added element 413 is connected to the pole element 411, and the length L2 is made to be the length of (¼)λ by using the wavelength λ corresponding to 2.45 [GHz]. That is, the multiband antenna 30 has the first resonance frequency. The multiband antenna 30 is consequently configured to be capable of obtaining the resonance frequencies in both of the 2.4 GHz band and the 5 GHz band of the wireless LAN communication.

Moreover, the length L3 of the ground element 421 is made to be the length of (¼)λ by using the wavelength λ corresponding to 2.45 [GHz], and the length L4 of the ground element 421 is made to be the length of (¼)λ by using the wavelength λ corresponding to the frequency in the 5 GHz band. The ground element 421 of the multiband antenna 30 consequently resonates in both of the 2.4 GHz band and 5 GHz band of the wireless LAN communication, and a higher gain can be obtained.

Moreover, because the folded-back element 412 is connected to the pole element 411 in the multiband antenna 30, the capacitance component between the end of the folded-back element 412 and the ground element 421 increases. The multiband antenna 30 consequently becomes one having a widened band of the second resonance frequency.

Next, as shown in FIG. 9, simulations of S parameters of the unit body of the multiband antenna 30 to frequencies were performed by changing the parameter P1. It was consequently found that the values of the S parameters (depths of resonance) changed according to the parameter P1. The depths of resonance of the multiband antenna 30 can accordingly be adjusted by changing the parameter P1.

The reason is that the lengths of the overlapping parts of the pole element 411, the folded-back element 412, and the added element 413 change by changing the parameter P1, and that the capacitive coupling and the inductive coupling between the respective elements consequently change.

Next, as shown in FIG. 10, simulations of the S parameters of the unit body of the multiband antenna 30 to frequencies were performed by changing the parameter P2. Because the length of the added element 413 was, however, fixed when the parameter P2 was changed, also the length L2 was changed. It was consequently found that the values of the S parameters corresponding to the first resonance frequencies changed according to the parameter P2. The first resonance frequency of the multiband antenna 30 can accordingly be adjusted by changing the parameter P2.

When the multiband antenna 30 was attached to the housing of the handy terminal 1 here, both of the first and the second resonance frequencies shifted to the lower side. It was supposed in consideration with this fact that the multiband antenna 30 was adjusted in order that the first resonance frequency may become higher by 0.5 [GHz]. As shown in FIG. 11, the voltage standing wave ratios (VSWRs) of the unit body of the multiband antenna 30, having the first resonance frequency adjusted to be higher, to frequencies were measured. Marks ∇1-∇4 are entered into FIG. 11 to denote the following frequencies: ∇1: 2.4 [GHz]; ∇2: 2.25 [GHz]; ∇3: 5.18 [GHz]; and ∇4: 5.7 [GHz]. The frequencies of the respective marks ∇1-∇4 are the same in the following diagrams of VSWRs. In FIG. 11, the first and the second resonance frequencies are shifted to the higher side.

Next, characteristics of the multiband antenna 30 in the state in which the multiband antenna 30 is attached to the housing of the handy terminal 1 will be described with reference to FIGS. 12-15.

Figure 12:
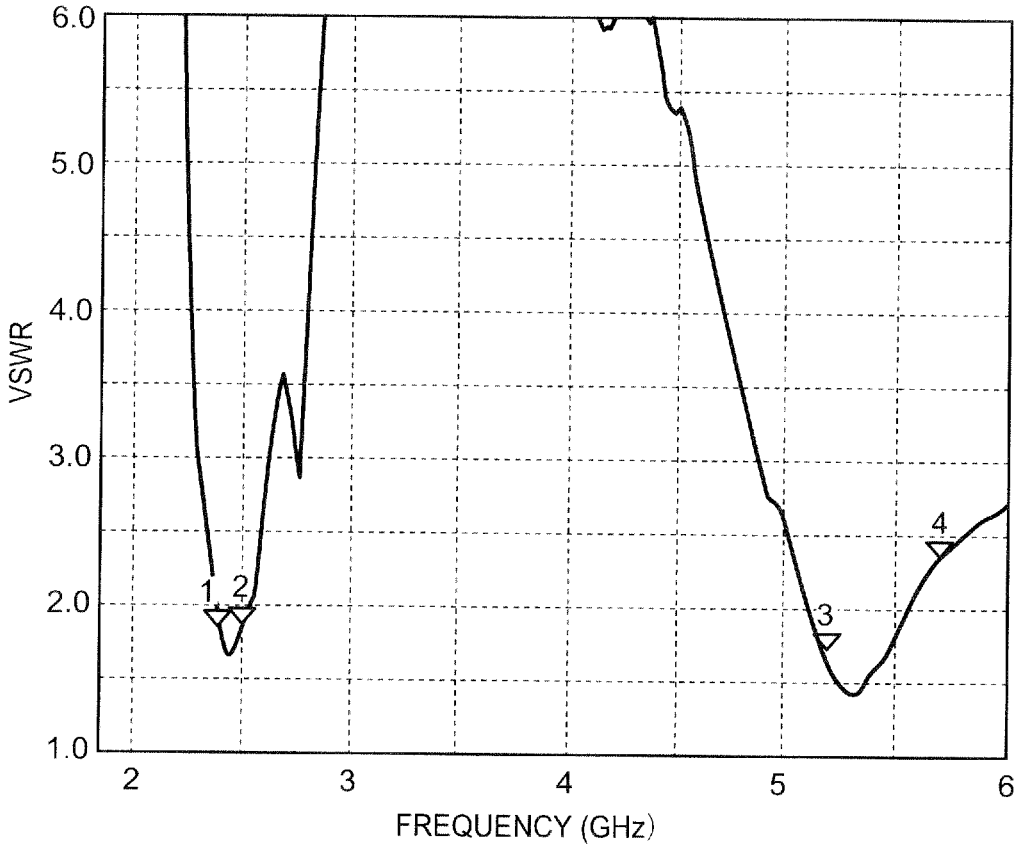
FIG. 12 is a diagram showing VSWRs of the multiband antenna of the embodiment in the state of being attached to the housing thereof to frequencies.

FIG. 12 is a diagram showing VSWRs of the multiband antenna 30 in the state of being attached to the housing to frequencies.

Figure 13A:
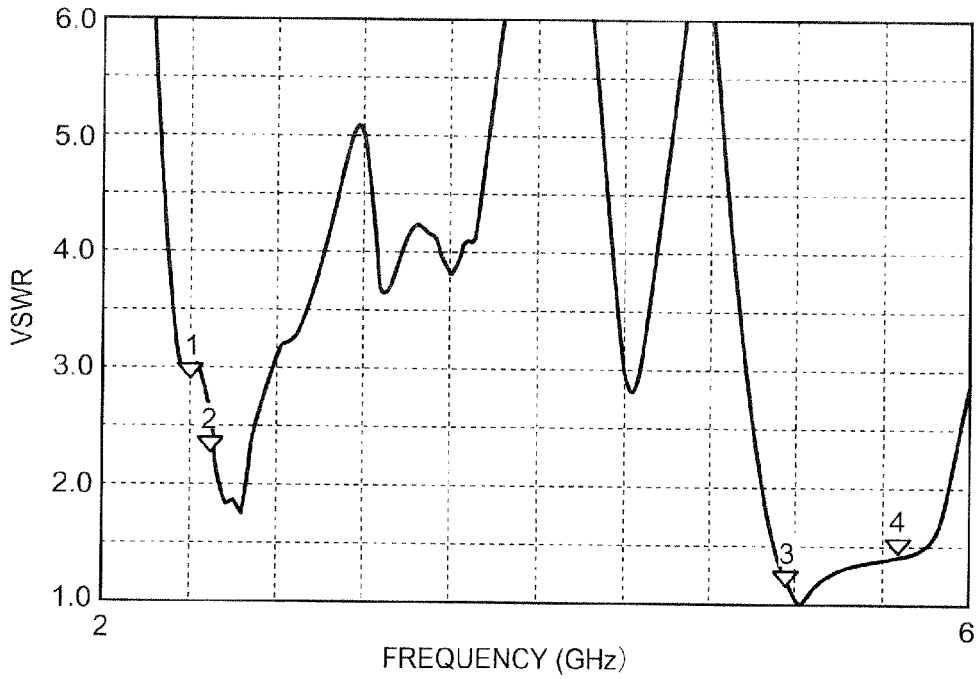
FIG. 13A is a diagram showing VSWRs of the multiband antenna of the embodiment in the state of being attached to the housing thereof at the time of the first parameter of 14.7 [mm] to frequencies.

FIG. 13A is a diagram showing VSWRs of the multiband antenna 30 in which the parameter P1 is set to 14.7 [mm] in the state of being attached to the housing to frequencies.

Figure 13B:
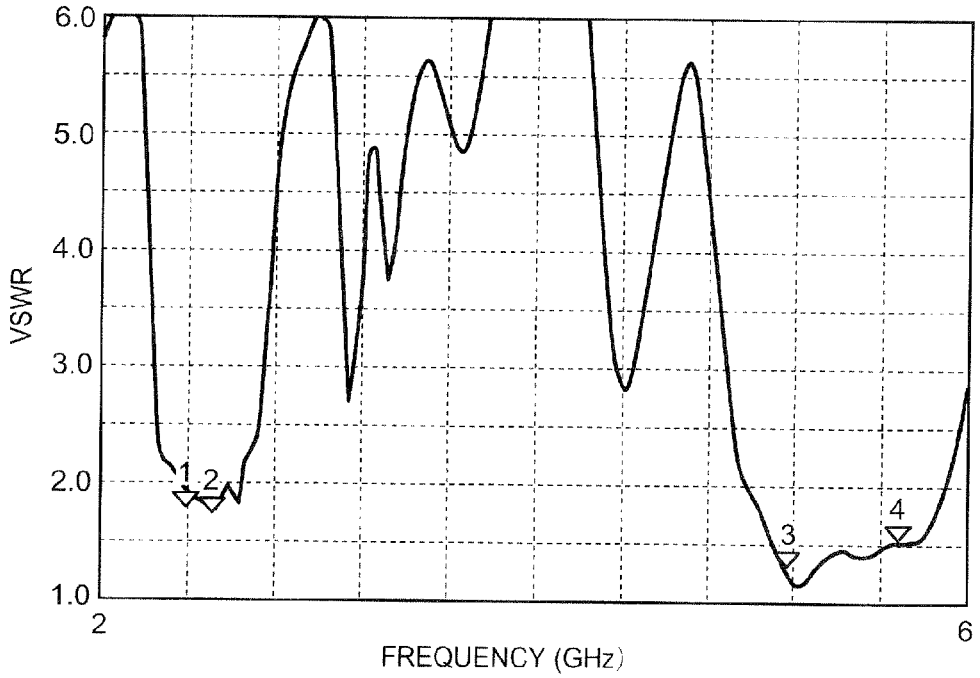
FIG. 13B is a diagram showing VSWRs of the multiband antenna of the embodiment in the state of being attached to the housing thereof at the time of the first parameter of 15.7 [mm] to frequencies.

FIG. 13B is a diagram showing VSWRs of the multiband antenna 30 in which the parameter P1 is set to 15.7 [mm] in the state of being attached to the housing to frequencies.

Figure 14A:
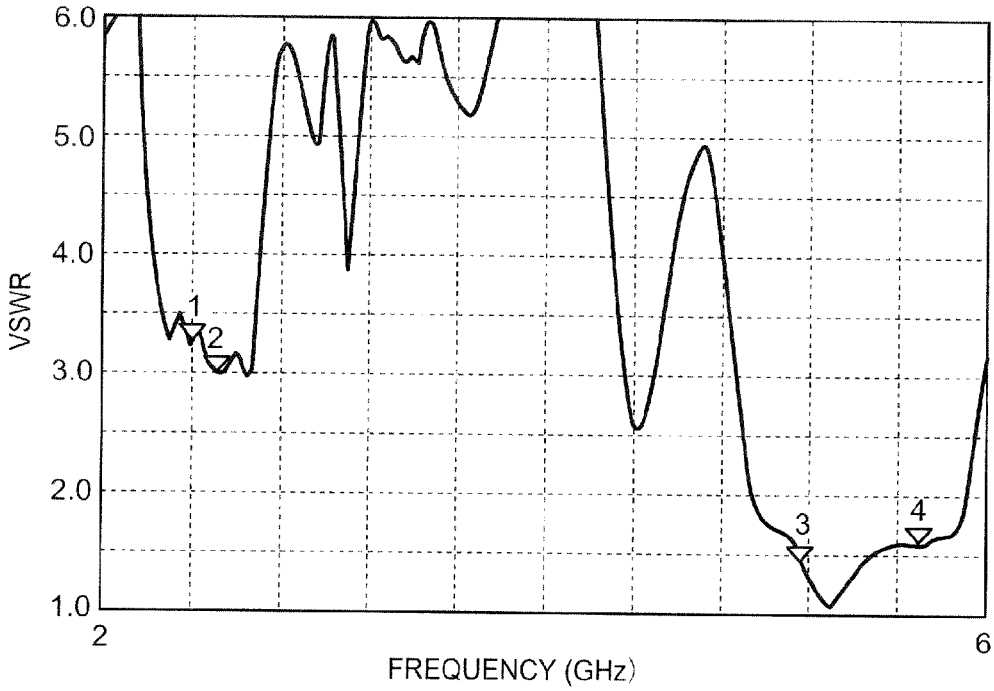
FIG. 14A is a diagram showing VSWRs of the multiband antenna of the embodiment in the state of being attached to the housing thereof at the time of the first parameter of 16.7 [mm] to frequencies.

FIG. 14A is a diagram showing VSWRs of the multiband antenna 30 in which the parameter P1 is set to 16.7 [mm] in the state of being attached to the housing to frequencies.

Figure 14B:
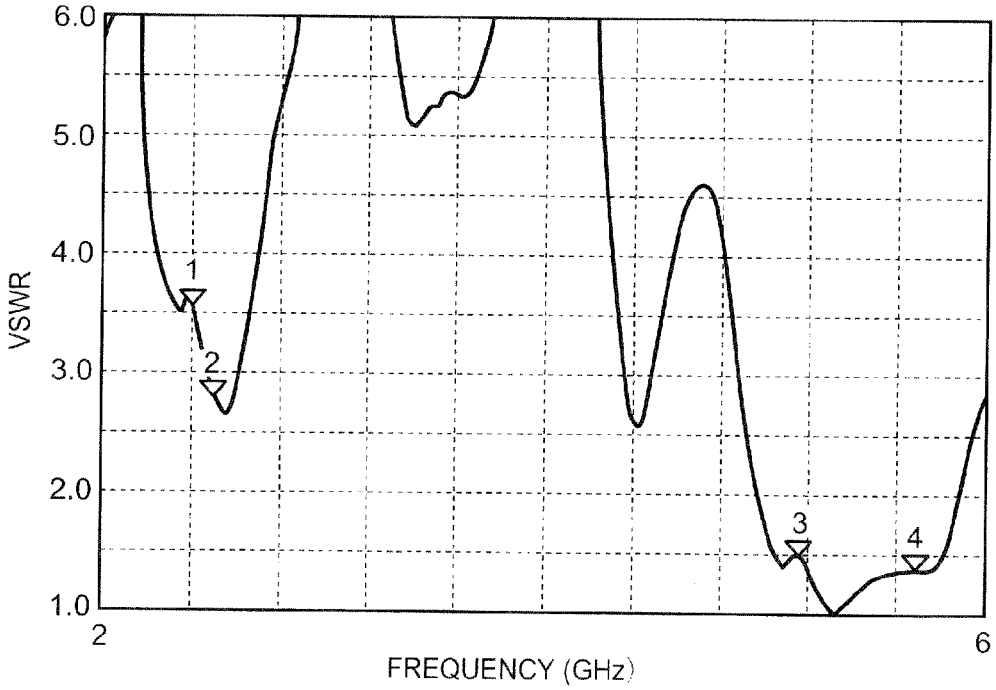
FIG. 14B is a diagram showing VSWRs of the multiband antenna of the embodiment in the state of being attached to the housing thereof at the time of the first parameter of 17.7 [mm] to frequencies.

FIG. 14B is a diagram showing VSWRs of the multiband antenna 30 in which the parameter P1 is set to 17.7 [mm] in the state of being attached to the housing to frequencies.

Figure 15:
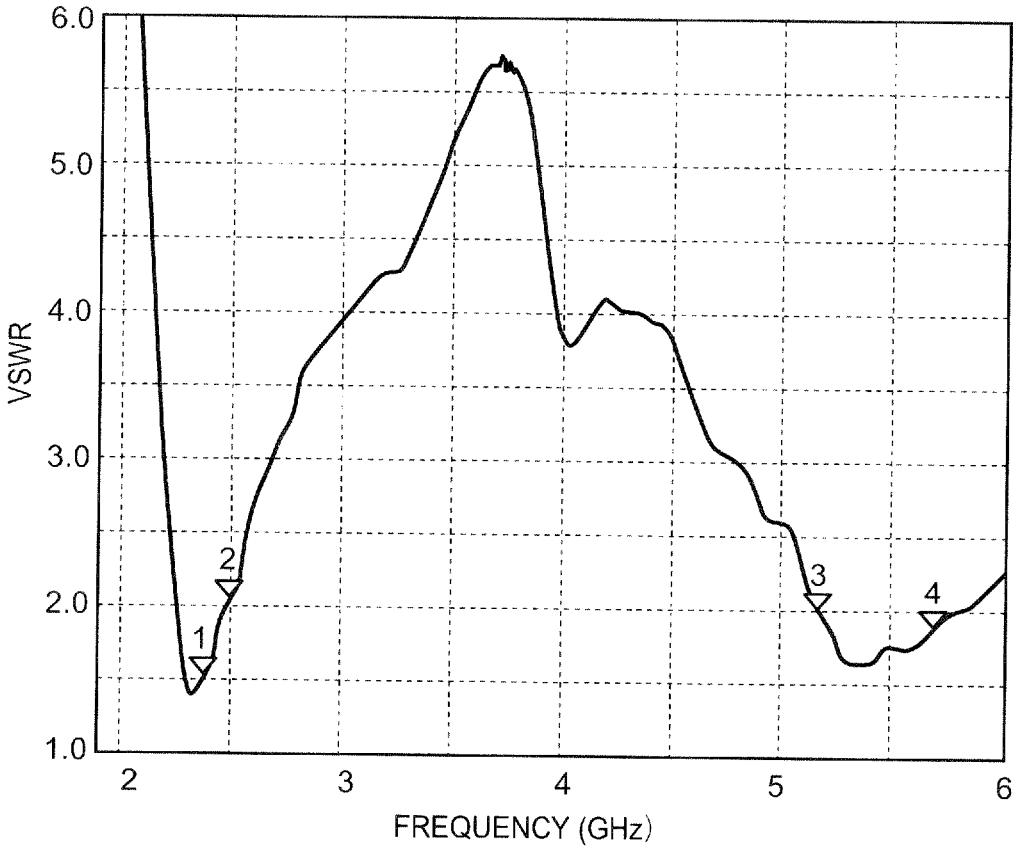
FIG. 15 is a diagram showing VSWRs of the multiband antenna of the embodiment in the state in which the handy terminal thereof is held in a hand to frequencies.

FIG. 15 is a diagram showing VSWRs of the multiband antenna 30 in the state in which the handy terminal 1 is held in a hand to frequencies.

As shown in FIG. 12, the VSWRs of the multiband antenna 30, having the first resonance frequency adjusted to be higher in FIG. 11 and being in the state of being attached to the housing of the housing terminal 1, to frequencies were measured. It was found that the multiband antenna 30 in the state of being attached to the housing resonated in the 2.4 GHz band and the 5 GHz band.

Next, as shown in FIGS. 13A, 13B, 14A, and 14B, VSWRs of the multiband antenna 30 to frequencies were measured by changing the parameter P1 to 14.7 [mm], 15.7 [mm], 16.7 [mm], and 17.7 [mm] in the state in which the multiband antenna 30 having the first resonance frequency adjusted to be higher in FIG. 11 was attached to the housing of the handy terminal 1. The values (depths of resonance) of VSWRs of the first resonance frequency of the multiband antenna 30 were capable of being adjusted when the parameter P1 was changed in the state of attaching the multiband antenna 30 to the housing. It was preferable to adjust the value of the VSWR of the first resonance frequency to the minimum parameter P1 (=15.7 [mm]) in the range of being 2.5 or less.

Next, as shown in FIG. 15, VSWRs of the multiband antenna 30 to frequencies were measured in the state in which the multiband antenna 30 was attached to the housing of the handy terminal 1 and an operator held the part of the housing of the handy terminal 1 in a hand of the operator in which part the multiband antenna 30 was mounted in the handy terminal 1.

As a result, the first and the second resonance frequencies of the multiband antenna 30 in the state of being held in the hand in FIG. 15 shifted to lower ones in comparison with those in the state of FIG. 12. To put it concretely, the first resonance frequency shifted from 2.45 [GHz] to 2.3 [GHz]. The second resonance frequency shifted from 5.35 [GHz] to 5.3 [GHz]. The shifted quantities of the first and the second resonance frequencies were little to be 50 [MHz], and the VSWRs were also 2.5 or less therein. The shifted quantities and the VSWRs were in the range of causing no problems in communication performance. Incidentally, because the multiband antenna 30 is made to be one having the second resonance frequency having a widened bandwidth owing to the folded-back element 412, the influences by being in the state of being held in a hand can be reduces even if the second resonance frequency has shifted.

Moreover, the depth of the second resonance frequency of the multiband antenna 30 in the state of being held in a hand in FIG. 15 became shallower in comparison with that in the state shown in FIG. 12. To put it concretely, the VSWR at the second resonance frequency was shifted from 1.45 to 1.7. The VSWR (the depth of resonance) at the second resonance frequency after the change was within a range in which no problems were caused in communication performance. The VSWR within the range in which no problems were caused in communication performance was 2.5 or less.

Moreover, the bandwidth of the second resonance frequency of the multiband antenna 30 in the state of being held in a hand in FIG. 15 was widened in comparison with that in the state shown in FIG. 12. To put it concretely, the bandwidth of the second resonance frequency was shifted from 450 [MHz] to 620 [MHz]. The bandwidth of the second resonance frequency after the change was widened, and no problems were consequently caused in communication performance.

As described above, according to the present embodiment, the multiband antenna 30 includes the antenna element section 41 and the ground element section 42. The pole element 411 of the antenna element section 41 has the length of (¼)λ at which the pole element 411 resonates at the first resonance frequency (a frequency in the 2.4 GHz band). The folded-back element 412 similarly has the length at which the folded-back element 412 resonates at the second resonance frequency together with the pole element 411 (resonates at the frequency being three times as large as that of the first resonance frequency in the 5 GHz band). The length of the added element 413 from the feeding point P to the end thereof is similarly (¼)λ at which the added element 413 resonates at the first resonance frequency (the frequency in the 2.4 GHz band).

Resonance can consequently be caused in arbitrary two frequency bands (e.g., the 2.4 GHz band and the 5 GHz band) in the multiband antenna 30 of the folding-back structure. Moreover, the band in which the second resonance frequency belongs can be widened.

Moreover, the added element 413 includes the elements 4131 and 4132. The depth of resonance of the first resonance frequency can be adjusted by adjusting the parameter P1 of the length of the element 4131. Moreover, the first resonance frequency can be adjusted by adjusting the parameter P2 of the length from the feeding point P to the connection point of the added element 413 and the pole element 411.

Moreover, the ground element section 42 includes the rectangular ground element 421, and the ground element 421 includes a side of the length (¼)λ at which the ground element 421 resonates at the first resonance frequency and a side of the length (¼)λ at which the ground element 421 resonates at the second resonance frequency. The gain of the multiband antenna 30 at the time of radiating electric waves at the first and the second resonance frequencies and receiving those electric waves can be heightened.

Moreover, the handy terminal 1 includes the multiband antenna 30, the wireless communication section 16, the CPU 11, and the like. Wireless LAN communication can consequently be performed in arbitrary two frequency bands (e.g., the 2.4 GHz band and the 5 GHz band) by using the multiband antenna 30 of the folding-back structure. Moreover, appropriate communication performance can be obtained even in the state in which the mounting part of the multiband antenna 30 in the handy terminal 1 is held in a hand.

(First Modification)

A first modification of the embodiment will be described with reference to FIGS. 16A-23. First, the apparatus configuration of the present modification will be described with reference to FIGS. 16A, 16B, and 17.

Figure 16A:
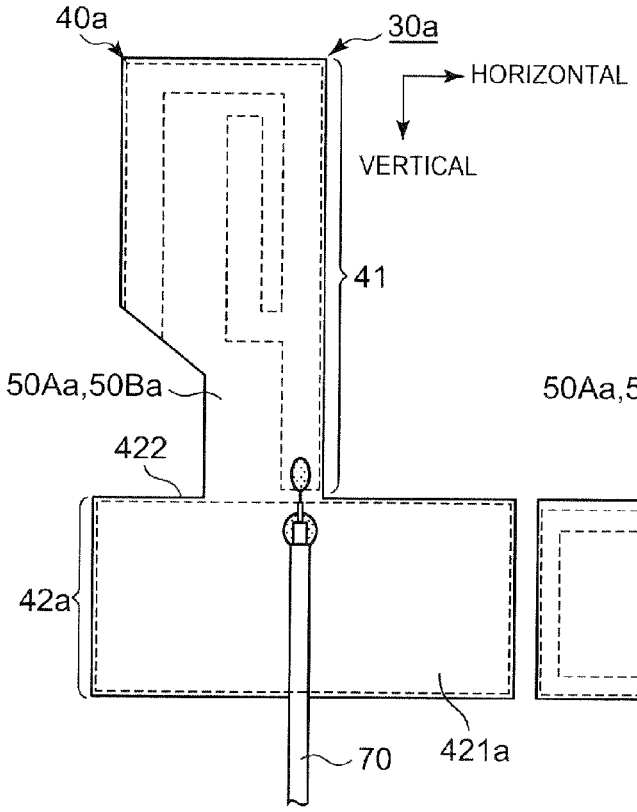
FIG. 16A is a front view of the multiband antenna of a first modification.

FIG. 16A is a front view showing the front configuration of the multiband antenna 30*a* of the present modification.

Figure 16B:
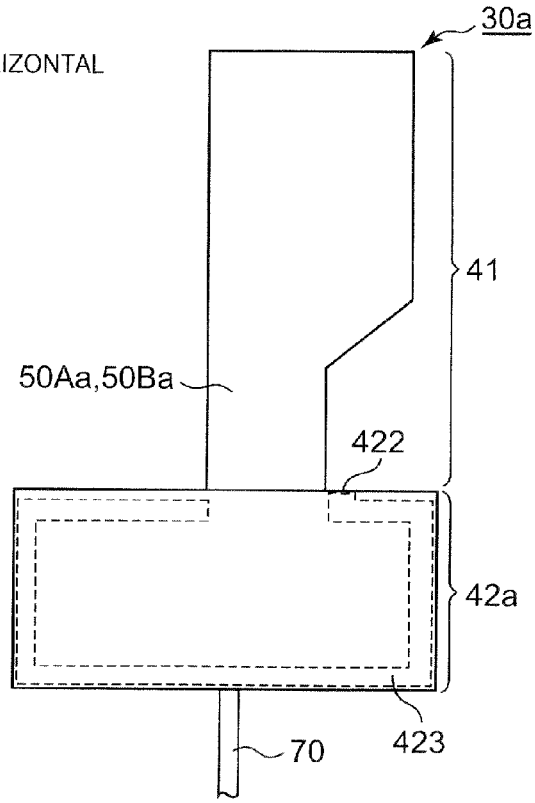
FIG. 16B is a rear view of the multiband antenna of the first modification.

FIG. 16B is a rear view showing the rear configuration of the multiband antenna 30*a*.

Figure 17:
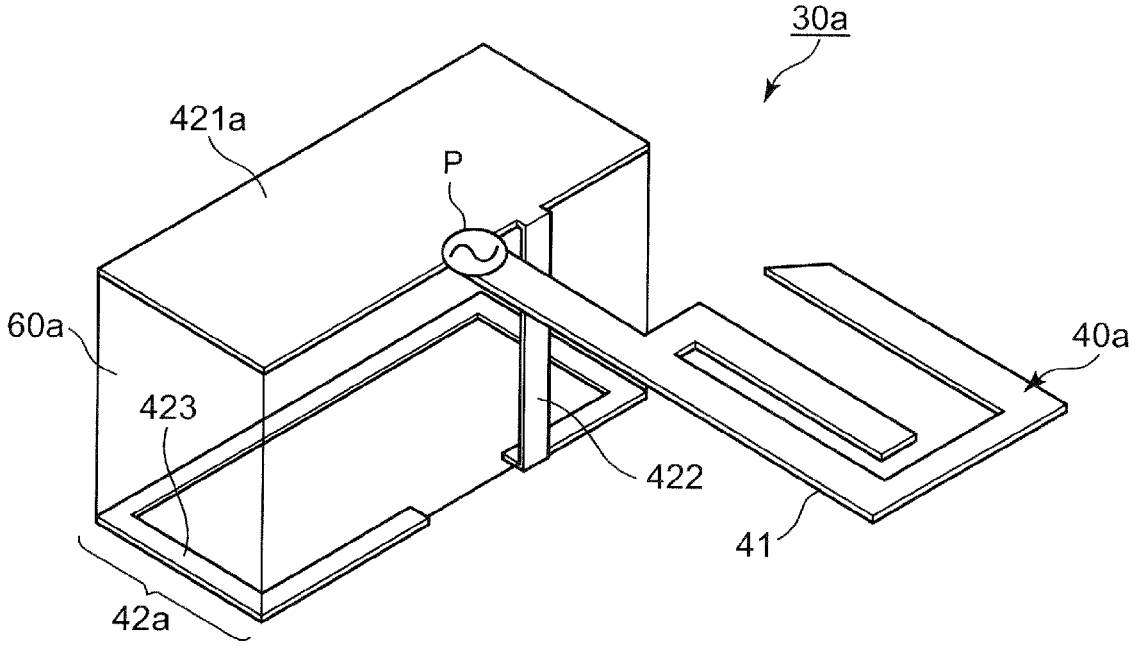
FIG. 17 is a perspective view of the multiband antenna of the first modification.

FIG. 17 is a perspective view showing the perspective configuration of the multiband antenna 30*a*.

The apparatus configuration of the present modification is one in which the multiband antenna 30 is replaced with the multiband antenna 30*a* in the handy terminal 1 of the embodiment described above. The same parts as those of the embodiment will be denoted by the same marks as those of the embodiment, and accordingly the configuration of the multiband antenna 30*a* will mainly be described.

As shown in FIGS. 16A, 16B, and 17, the multiband antenna 30*a* includes a conductor section 40*a*, and film sections 50Aa and 50Ba. However, the illustration of the film sections 50Aa and 50Ba is omitted in FIG. 17. The film sections 50Aa and 50Ba have apparatus configurations similar to those of the film sections 50A and 50B of the embodiment and are pasted to the conductor section 40*a* to prevent the exposure of the conductor section 40*a*.

The conductor section 40*a* is made of a conductor of a metal, such as copper foil. The conductor section 40*a* includes an antenna element section 41 and a ground element section 42*a*. The ground element section 42*a* includes a ground element 421*a*, a connection element 422, and a spiral element 423.

The ground element 421*a* is a rectangular element. The connection element 422 is a belt-like element connecting the ground element 421*a* and the spiral element 423. The spiral element 423 is a belt-like element separated from the ground element 421*a* by a predetermined distance to be arranged in parallel with the surface of the ground element 421*a*. The spiral element 423 extends in a spiral at a position opposed to the ground element 421*a* and corresponding to the peripheral part of the ground element 421*a*.

Moreover, a separation section 60*a* is arranged between the ground element 421*a* and the spiral element 423. The separation section 60*a* is made of a spongy insulator or the like similarly to the separation section 60 of the embodiment.

Moreover, as shown in FIG. 16A, the horizontal direction is set to the direction parallel to the upper side of the ground element 421*a* of the multiband antenna 30*a* in the state in which the multiband antenna 30*a* is attached to the handy terminal 1 and the lower part of the front surface of the handy terminal 1 faces to the gravitation direction. The vertical direction is set to the direction parallel to the extending direction of the pole element 411 of the multiband antenna 30*a* in the same state.

Next, the characteristics of the multiband antenna 30*a* will be described with reference to FIGS. 18-23.

Figure 18:
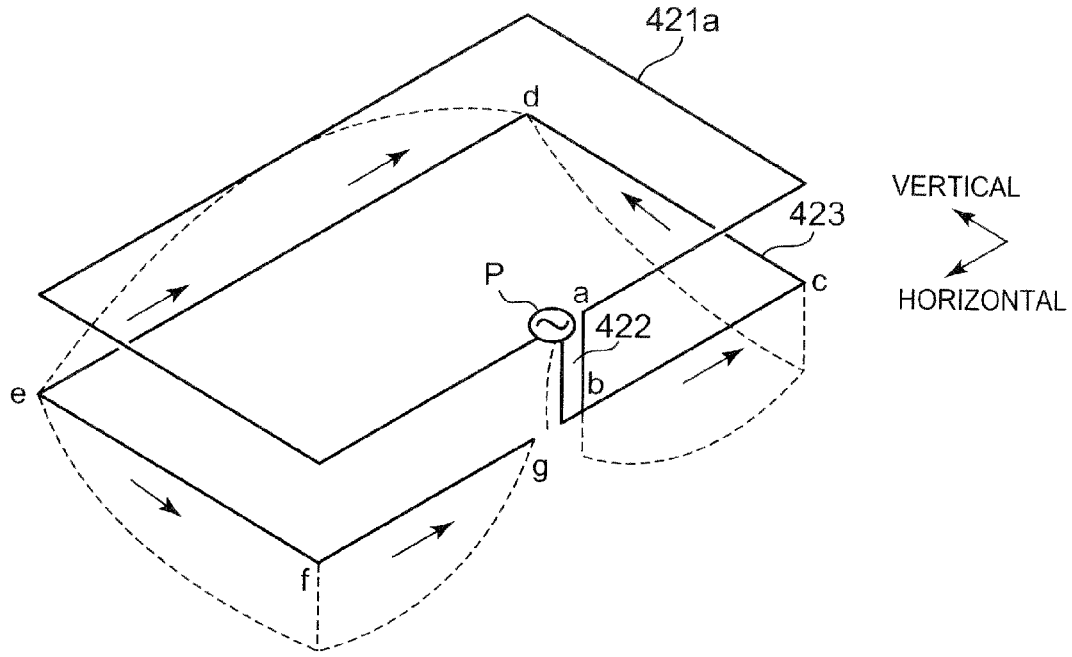
FIG. 18 is a view showing distribution of current flows of the multiband antenna of the first modification in a resonant state at 5 [GHz]

FIG. 18 is a view showing distribution of current flows in the multiband antenna 30*a* in a resonant state at 5 [GHz].

Figure 19:
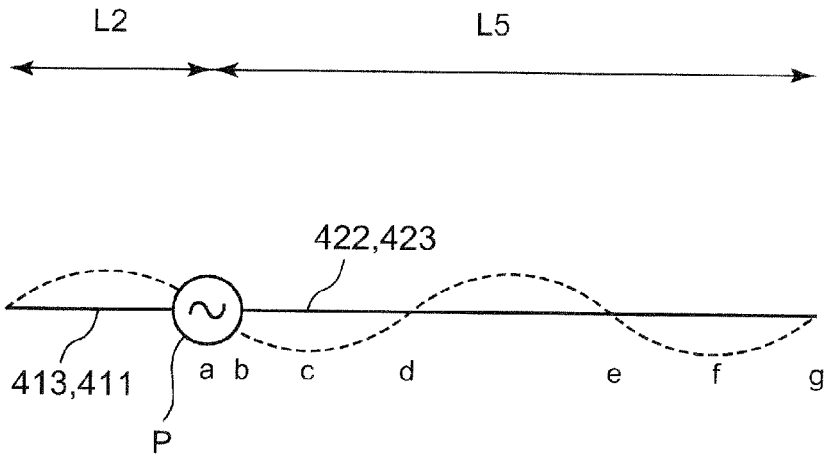
FIG. 19 is a diagram showing distribution of a current flow on a straight line of the multiband antenna of the first modification in the resonant state at 5 [GHz]

FIG. 19 is a diagram showing distribution of a current flow on a straight line of the multiband antenna 30*a* in the resonant state at 5 [GHz].

Figure 20:
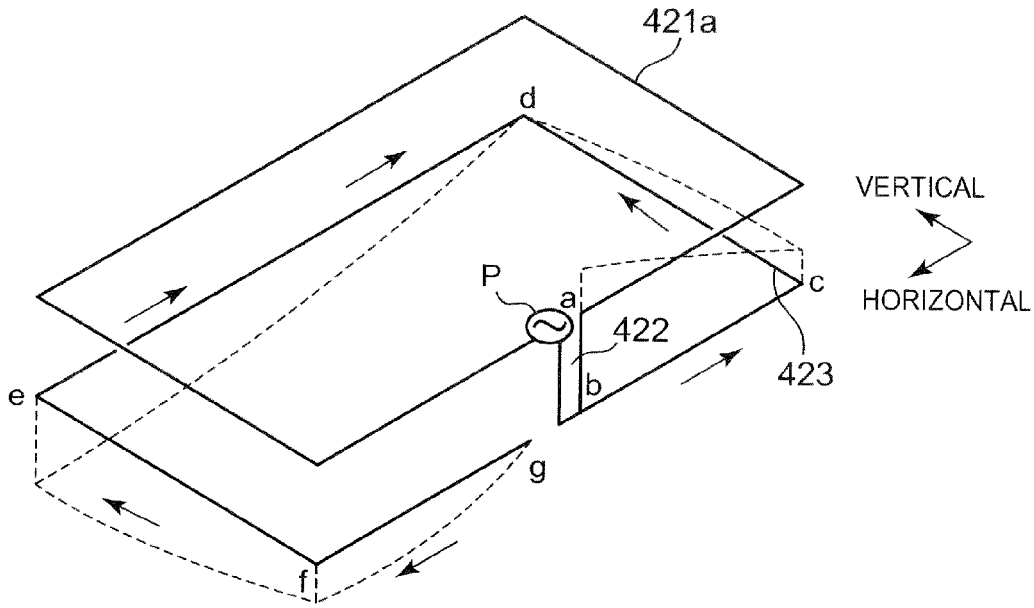
FIG. 20 is a view showing distribution of current flows of the multiband antenna of the first modification in a resonant state at 2.5 [GHz]

FIG. 20 is a view showing distribution of current flows of the multiband antenna 30*a* in a resonant state at 2.5 [GHz].

Figure 21:
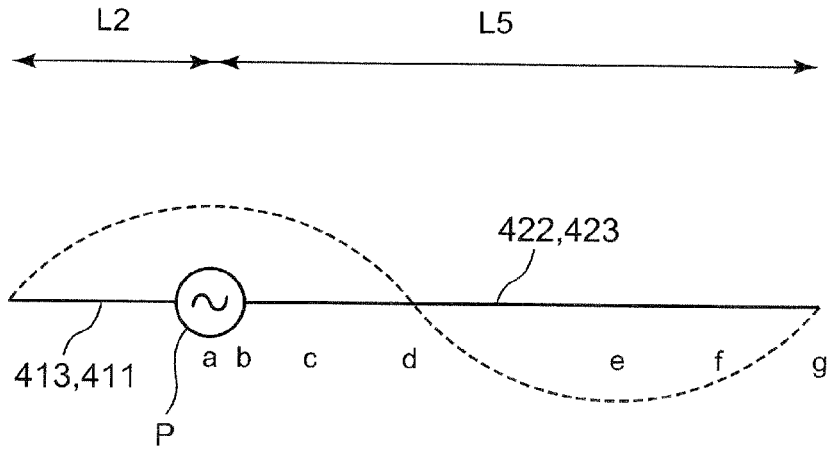
FIG. 21 is a diagram showing distribution of a current flow on a straight line of the multiband antenna of the first modification in the resonant state at 2.5 [GHz]

FIG. 21 is a diagram showing distribution of a current flow on a straight line of the multiband antenna 30*a* in the resonant state of 2.5 [GHz].

Figure 22A:
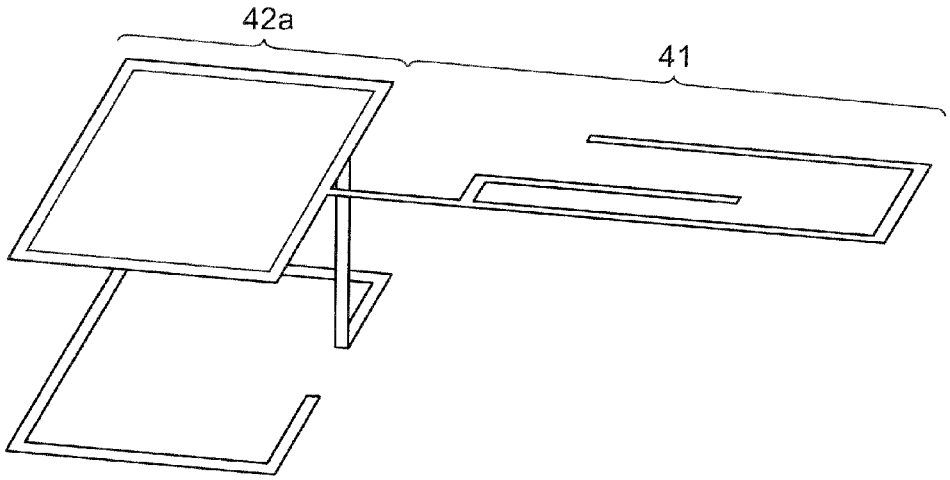
FIG. 22A is a view showing distribution of current quantities of the multiband antenna of the first modification at a frequency in a 2.5 GHz band.

FIG. 22A is a view showing distribution of current quantities of the multiband antenna 30*a* at a frequency in a 2.5 GHz band.

Figure 22B:
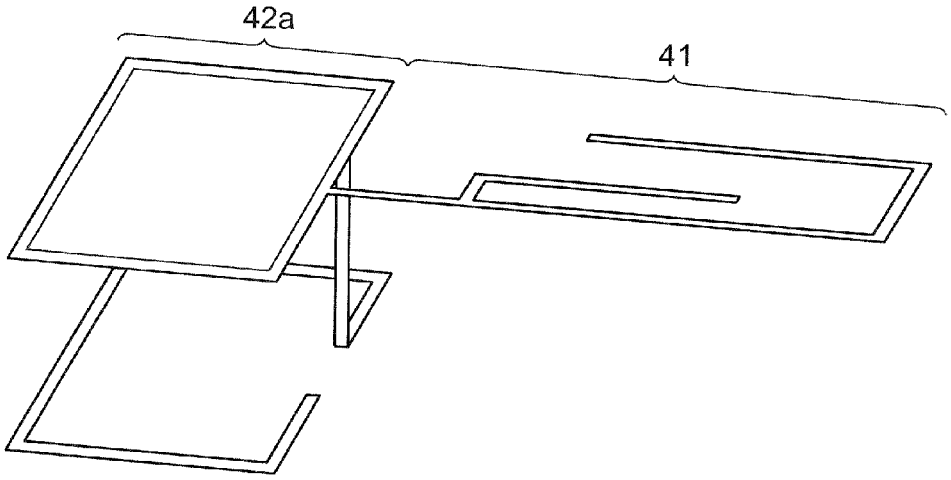
FIG. 22B is a view showing distribution of current quantities of the multiband antenna of the first modification at a frequency in a 5 GHz band.

FIG. 22B is a view showing distribution of current quantities of the multiband antenna 30*a* at a frequency in the 5 GHz band.

Figure 23:
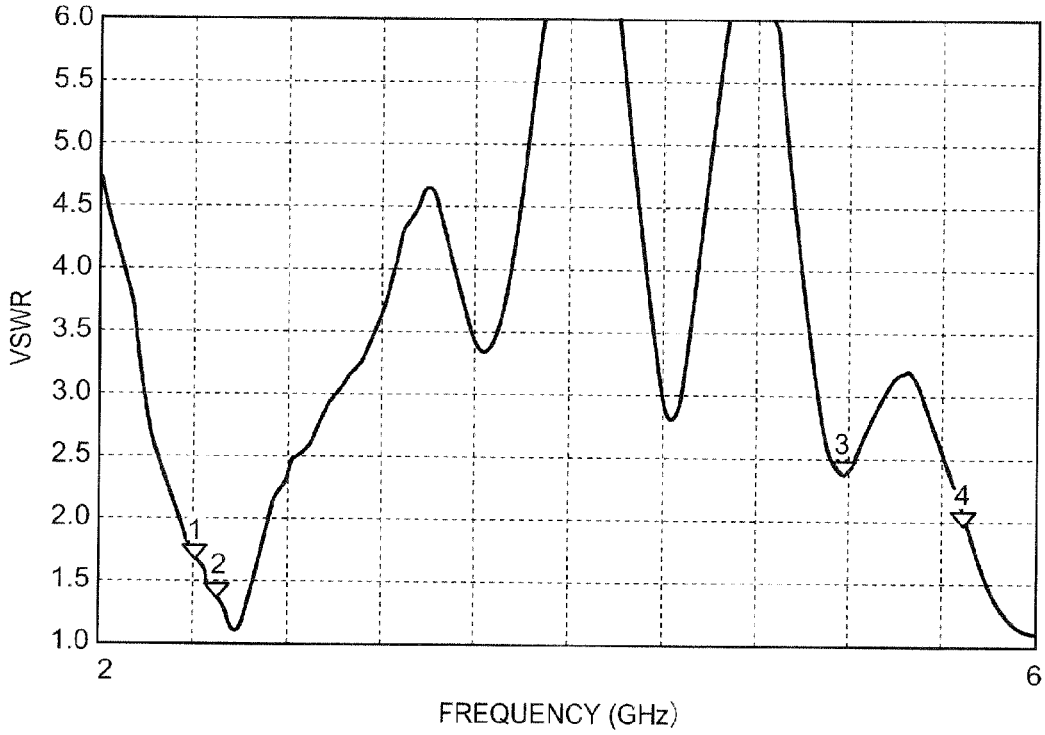
FIG. 23 is a diagram showing VSWRs of the multiband antenna of the first modification in the state of being attached to the housing thereof to frequencies.

FIG. 23 is a diagram showing VSWRs of the multiband antenna 30*a* in the state of being attached in the housing thereof to frequencies.

The multiband antenna 30 of the embodiment described above is a variation of a reverse L antenna. In the reverse L antenna, because electric waves radiated from a current in the horizontal direction transmit into reverse directions in the respective elements of the antenna element and the ground element of the reverse L antenna, the electric waves in the horizontal direction are cancelled to be weakened, and consequently the electric waves radiated from a current in the vertical direction occupy the principal parts of the electric waves of the reverse L antenna.

Because the handy terminal 1 is used in the states of being arranged in various directions, the situation in which the handy terminal 1 does not meet a polarized wave at an access point also arises. Moreover, because the handy terminal 1 is usually used in an environment in which reflections of electric waves are frequently generated by a shelf, a wall, and the like in a room, an antenna capable of coping with polarized waves could stably transmit and receive electric waves. The connection element 422 and the spiral element 423 are accordingly provided to the multiband antenna 30*a*.

First, the length of each section of the ground element section 42*a* will be described. As shown in FIG. 18, the connection point of the ground element 421*a* and the connection element 422 is denoted as a point a. The connection point of the connection element 422 and the spiral element 423 is denoted as a point b. Then, the right-angled parts of the spiral element 423 from the point b to the point g at the end are denoted as a point c, a point d, a point e, and a point f in order.

It is supposed here that the wavelength λ of the frequency of 2.5 [GHz] is denoted as λ1, and that the wavelength λ of the frequency of 5 [GHz] is denoted as λ2. The frequency 2.5 [GHz] is included in the 2.4 GHz band of wireless LAN communication. The frequency 5 [GHz] is a value in the neighborhood of the range of the 5 GHz band of the wireless LAN communication.

The length from the point a to the point c is set to $(1/4)\lambda 2=(1/8)\lambda 1$. The length from the point c to the point d is set to $(1/4)\lambda 2=(1/8)\lambda 1$. The length from the point d to the point e is set to $(1/2)\lambda 2=(1/4)\lambda 1$. The length from the point e to the point f is set to $(1/4)\lambda 2=(1/8)\lambda 1$. The length from the point f to the point g is set to $(1/4)\lambda 2=(1/8)\lambda 1$. In such a way, the length from the feeding point P to the point g through the points a, b, c, d, e, and f in order is set to a length $L5=(3/2)\lambda 2=(3/4)\lambda 1$.

When the multiband antenna 30*a* receives an electric wave of the frequency of 5 [GHz], the resonance of currents into the directions shown in FIG. 18 are generated. Because the directions of the currents are reverse in the part from the point c to the point d and in the part from the point e to the point f, vertically polarized waves are cancelled. On the other hand, because the directions of the currents are the same in the part from the point b to the point c, the part from the point e to the point d, and the part from the point f to the point g, horizontally polarized waves are reinforced. The horizontally polarized waves can thus be received when the electric waves of the frequencies of 5 [GHz] are received.

As shown in FIG. 19, if the part from the end of the added element 413 to the spiral element 423 including the pole element 411, the feeding point P (the ground element 421*a*), and the connection element 422 is made to be a straight line, it is found that a current of the frequency of 5 [GHz] resonates on the straight line.

Moreover, when the multiband antenna 30*a* receives an electric wave of the frequency of 2.5 [GHz], the resonance of currents into the directions shown in FIG. 20 are generated. Because the directions of the currents are the same in the part from the point c to the point d and in the part from the point e to the point f, vertically polarized waves are reinforced. On the other hand, because the directions of the currents are the same or reverse in the part from the point b to the point c, the part from the point e to the point d, and the part from the point f to the point g, horizontally polarized waves are reinforced by a little. The horizontally polarized waves can thus be received when the electric waves of the frequencies of 2.5 [GHz] are received.

As shown in FIG. 21, if the part from the end of the added element 413 to the spiral element 423 including the pole element 411, the feeding point P (the ground element 421*a*), and the connection element 422 is made to be a straight line, it is found that a current of the frequency of 2.5 [GHz] resonates on the straight line.

Next, as shown in FIG. 22A, a simulation of distribution of current quantities of the multiband antenna 30*a* at the time of receiving an electric wave of a frequency in the 2.4 GHz band was performed. In FIG. 22A, the larger of a current quantity is, the whiter the part where the current flows is illustrated to be. The smaller a current is, the blacker the part where the current flows is illustrated to be. The illustration method is the same in the following views showing distribution of current flows. From FIG. 22A, it can be ascertained that currents flow through the connection element 422 and the spiral element 423 at the time of receiving the electric wave of the frequency in the 2.4 GHz band.

As shown in FIG. 22B, a simulation of distribution of current quantities of the multiband antenna 30*a* at the time of receiving an electric wave of a frequency in the 5 GHz band was performed. From FIG. 22B, it can be ascertained that currents flow through the connection element 422 and the spiral element 423 at the time of receiving the electric wave of the frequency in the 5 GHz band.

Next, as shown in FIG. 23, the VSWRs of the multiband antenna 30*a* to frequencies were measured in the state in which the multiband antenna 30*a* was attached to the housing of the handy terminal 1. It was found that the VSWRs of the multiband antenna 30*a* were sufficiently low in the 2.4 GHz band and the 5 GHz band of wireless LAN communication, whereby resonance can be obtained.

As described above, according to the present modification, the ground element section 42*a* includes the spiral element 423 connected to the ground element 421*a* and arranged at a position opposed to the peripheral part of the ground element 421*a*. Moreover, the length from the end of the added element 413 to the end of the spiral element 423 through the pole element 411, the feeding point P, the ground element 421*a*, and the connection element 422 in order is one at which the multiband antenna 30*a* resonates at the first and the second resonance frequencies. The multiband antenna 30*a* can thereby stably radiate and receive polarized waves in the horizontal direction perpendicular to the main polarized wave direction of the antenna element section 41 at the first and the second resonance frequencies, and the multiband antenna 30*a* can stably perform the radiation and the reception of electric waves.

(Second Modification)

A second modification of the embodiment will be described with reference to FIGS. 24A-25. First, the apparatus configuration of the present modification will be described with reference to FIGS. 24A, 24B, and 25.

Figure 24A:
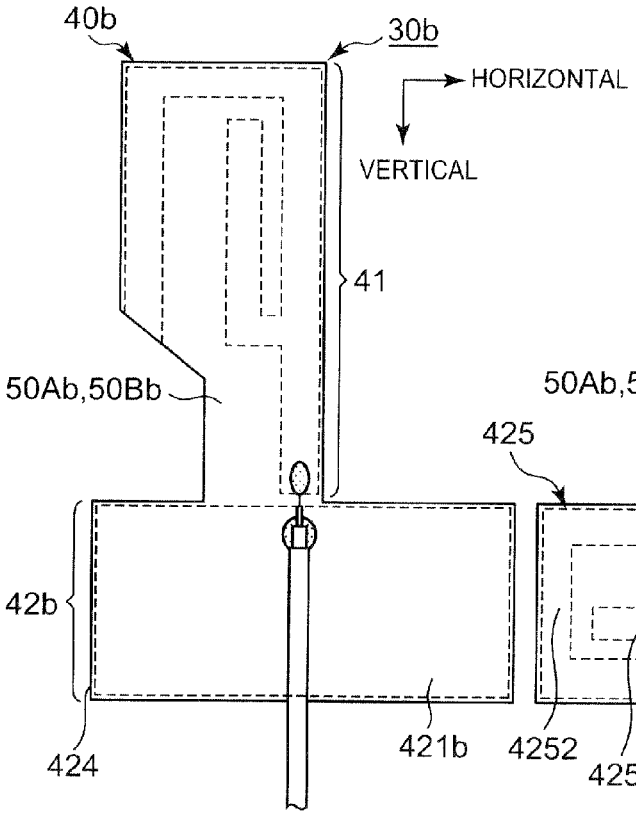
FIG. 24A is a front view of the multiband antenna of a second modification.

FIG. 24A is a front view showing the front configuration of the multiband antenna 30*b* of the present modification.

Figure 24B:
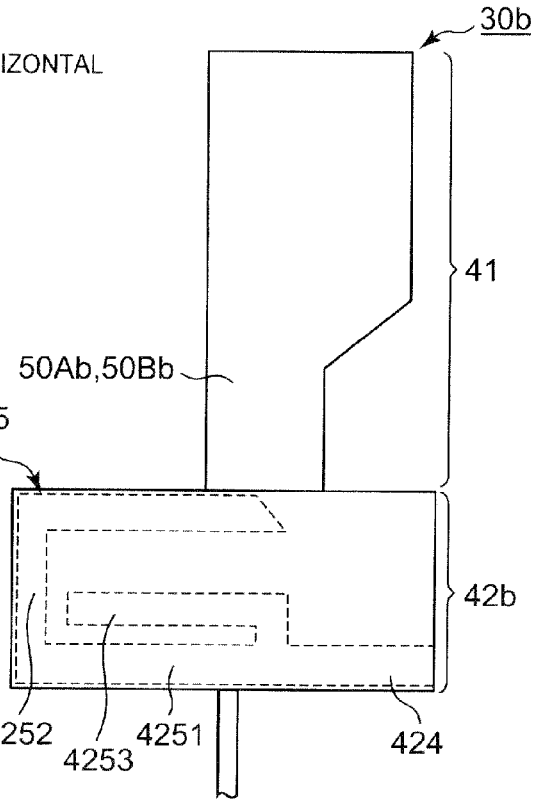
FIG. 24B is a rear view of the multiband antenna of the second modification.

FIG. 24B is a rear view showing the rear configuration of the multiband antenna 30*b*.

Figure 25:
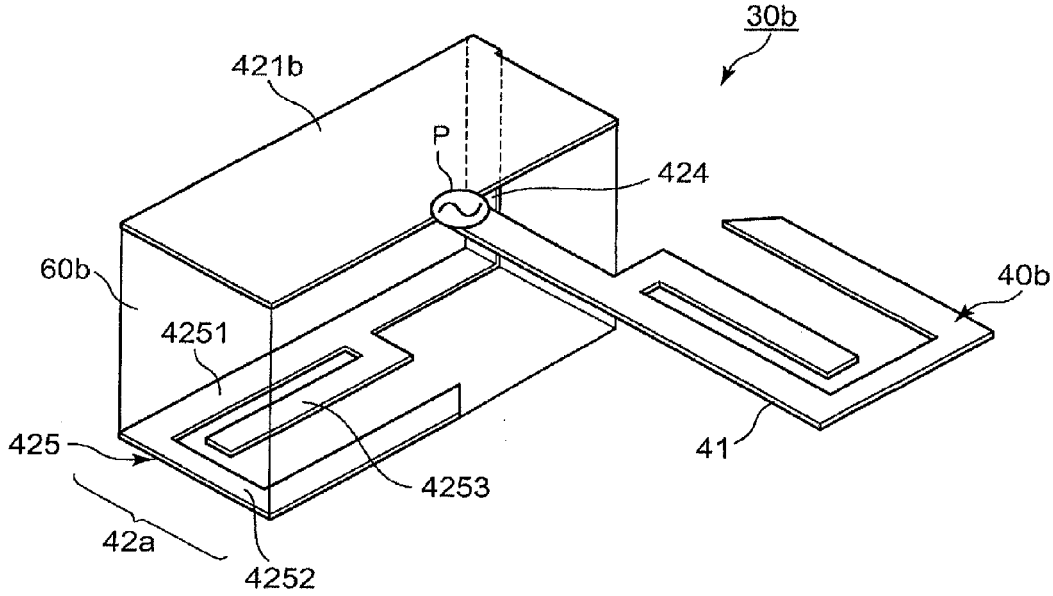
FIG. 25 is a perspective view of the multiband antenna of a second modification.
Figure 26:
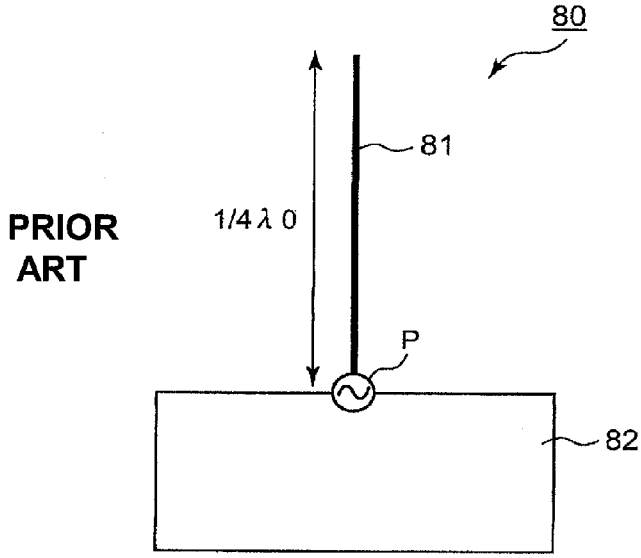
FIG. 26 is a view showing the configuration of a conventional monopole antenna.

FIG. 25 is a perspective view showing the perspective configuration of the multiband antenna 30*b*.

The apparatus configuration of the present modification is one in which the multiband antenna 30 is replaced with the multiband antenna 30*b* in the handy terminal 1 of the embodiment described above. The same parts as those of the embodiment will be denoted by the same marks as those of the embodiment, and accordingly the configuration of the multiband antenna 30*b* will mainly be described.

As shown in FIGS. 24A, 24B, and 25, the multiband antenna 30*b* includes a conductor section 40*b*, and film sections 50Ab and 50Bb. However, the illustration of the film sections 50Ab and 50Bb is omitted in FIG. 25. The film sections 50Ab and 50Bb have apparatus configurations similar to those of the film sections 50A and 50B of the embodiment and are pasted to the conductor section 40*b* to prevent the exposure of the conductor section 40*b*.

The conductor section 40*b* is made of a conductor of a metal, such as copper foil. The conductor section 40*b* includes an antenna element section 41 and a ground element section 42*b*. The ground element section 42*b* includes a ground element 421*b*, a connection element 424, and a ground antenna element section 425.

The ground element 421*b* is a rectangular element and has a shape similar to that of the ground element 421 of the embodiment. The connection element 424 is a belt-like element connecting the ground element 421*b* and the ground antenna element section 245.

The ground antenna element section 425 is arranged at a position opposed to the ground element 421*b* and has a shape similar to the antenna element section 41. To put it concretely, the ground antenna element section 425 includes a pole element 4251, a folded-back element 4252, and an added element 4253. The pole element 4251, the folded-back element 4252, and the added element 4253 are similar to the pole element 411, the folded-back element 412, and the added element 413, respectively.

Moreover, a separation section 60*b* is arranged between the ground element 421*b* and the ground antenna element section 425. The separation section 60*b* is made of a spongy insulator or the like similarly to the separation section 60 of the embodiment.

Next, the characteristics of the multiband antenna 30*b* will be described. As described pertaining to the first modification, the antenna element section 41 mainly receives and radiates electric waves in the vertical direction (vertically polarized wave) shown in FIG. 24A. The ground antenna element section 425 is accordingly provided to the multiband antenna 30*b*.

The extending direction of the antenna element section 41 (the extending direction of the pole element 411) is the vertical direction, and the extending direction of the ground antenna element section 425 (the extending direction of the pole element 4251) is the horizontal direction. The polarized wave surfaces of the antenna element section 41 and the ground antenna element section 425 are consequently different from each other by 90 degrees. The multiband antenna 30*b* can thereby receive (radiate) vertically polarized waves with the antenna element section 41 and can receive (radiate) horizontally polarized waves with the ground antenna element section 425.

As described above, according to the present modification, the ground element section 42*b* has the same shape as that of the antenna element section 41 and has the ground antenna element section 425 having the extending direction perpendicular to that of the antenna element section 41. The multiband antenna 30*b* can radiate and receive electric waves of the polarized waves in the horizontal direction perpendicular to the main polarized wave direction of the antenna element section 41 at the first and the second resonance frequencies, and the multiband antenna 30*b* can stably perform radiation and reception of electric waves.

According to the preferred embodiment and modifications thereof of the present invention, a multiband antenna having the folding-back structure capable of resonating at two arbitrary frequency bands can be provided.

Incidentally, the descriptions of the embodiment and the respective modifications are only examples of the multiband antenna and the electronic device according to the present invention, and the present invention are not limited to those embodiment and modifications.

Moreover, although the embodiment and the respective modifications are configured as handy terminals as the electronic devices having the wireless communication functions, the present invention is not limited to the handy terminals. The present invention can also be applied to the other electronic devices, such as a personal digital assistant (PDA), a cellular phone handset, a personal handy phone system (PHS) terminal, a netbook, and an electronic book reader as the electronic devices having wireless communication functions.

Moreover, although the embodiment and the respective modifications are configured to paste two layers of film sections to both the surfaces of the conductor section of each of the multiband antennas, the present invention is not limited to such a configuration. The configuration of pasting one layer of film section to one surface of the conductor section of a multiband antenna may be adopted.

Moreover, although the embodiment and the respective modifications use wireless LAN communication system having two communication bands as the wireless system of the multiband antennas, the wireless system is not limited to the wireless LAN communication system. The wireless systems of the multiband antennas may be configured as wireless communication systems having other communication bands.

Moreover, it is needless to say that configurational details and operational details of the respective components of the multiband antenna and the handy terminal of each of the embodiment and the modifications can suitably be changed without departing from the sprit and the scope of the present invention.

What is claimed is:

1. A multiband antenna, comprising:

an antenna element section which is fed from a feeding point; and a ground element section which is connected to a ground of the feeding point;

wherein the antenna element section includes:

a pole element which includes the feeding point, and has a length at which the pole element resonates at a first frequency;

an L-shaped folded-back element which is connected to an end of the pole element, and resonates at a second frequency together with the pole element; and an L-shaped added element which is connected to the pole element;

wherein a length from the feeding point to an end of the added element is a length at which the added element resonates at the first frequency;

wherein the ground element section includes a rectangular ground element; and wherein the ground element includes a side having a length at which the ground element resonates at the first frequency, and a side having a length at which the ground element resonates at the second frequency.

2. The multiband antenna according to claim 1, wherein:

the added element includes a first element parallel to the pole element, and a second element perpendicular to the pole element;

a depth of resonance of the first frequency is adjusted by an adjustment of a length of the first element; and the first frequency is adjusted by an adjustment of a length from the feeding point to a connection point of the added element and the pole element.

3. The multiband antenna according to claim 1, wherein the ground element section includes a spiral element which is connected to the ground element, and is arranged at a position opposed to a peripheral part of the ground element.

4. The multiband antenna according to claim 3, wherein a length from the end of the added element to an end of the spiral element through the pole element, the feeding point and the ground element is a length at which the multiband antenna resonates at the first frequency and the second frequency.

5. The multiband antenna according to claim 1, wherein:

the ground element section includes a ground antenna element section which is connected to the ground element, and is arranged at a position opposed to the ground element; and the ground antenna element section has a shape which is the same as a shape of the antenna element section, and has an extending direction perpendicular to an extending direction of the antenna element section.

6. An electronic device comprising:

a multiband antenna;

a wireless communication section which performs wireless communication with an external device through the multiband antenna; and a control section which controls the wireless communication section;

wherein the multiband antenna includes:

an antenna element section which is fed from a feeding point; and a ground element section which is connected to a ground of the feeding point;

wherein the antenna element section includes:

a pole element which includes the feeding point, and has a length at which the pole element resonates at a first frequency;

an L-shaped folded-back element which is connected to an end of the pole element, and resonates at a second frequency together with the pole element; and an L-shaped added element which is connected to the pole element;

wherein:

a length from the feeding point to an end of the added element is a length at which the added element resonates at the first frequency;

the ground element section includes a rectangular ground element; and the ground element includes a side having a length at which the ground element resonates at the first frequency, and a side having a length at which the ground element resonates at the second frequency.

7. A multiband antenna, comprising:

an antenna element section which is fed from a feeding point; and a ground element section which is connected to a ground of the feeding point;

wherein the antenna element section includes:

a pole element which includes the feeding point, and has a length at which the pole element resonates at a first frequency;

an L-shaped folded-back element which is connected to an end of the pole element, and resonates at a second frequency together with the pole element; and an L-shaped added element which is connected to the pole element;

wherein a length from the feeding point to an end of the added element is a length at which the added element resonates at the first frequency;

wherein the ground element section includes a rectangular ground element; and wherein the ground element section includes a spiral element which is connected to the ground element, and is arranged at a position opposed to a peripheral part of the ground element.

8. The multiband antenna according to claim 7, wherein a length from the end of the added element to an end of the spiral element through the pole element, the feeding point and the ground element is a length at which the multiband antenna resonates at the first frequency and the second frequency.

* * * * *